US008177317B2

(12) United States Patent
Ito et al.

(10) Patent No.: US 8,177,317 B2
(45) Date of Patent: May 15, 2012

(54) IMAGE RECORDING APPARATUS

(75) Inventors: Tsuyoshi Ito, Nagoya (JP); Takashi Ohama, Iwakura (JP); Naokazu Tanahashi, Nagoya (JP); Wataru Sugiyama, Aichi-ken (JP); Noriyuki Kawamata, Nagoya (JP); Yuta Uchino, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 415 days.

(21) Appl. No.: 12/569,442

(22) Filed: Sep. 29, 2009

(65) Prior Publication Data

US 2010/0079529 A1 Apr. 1, 2010

(30) Foreign Application Priority Data

Sep. 29, 2008 (JP) ..... 2008-251642

(51) Int. Cl.
*B41J 29/38* (2006.01)
*B41J 29/393* (2006.01)
*B41J 2/01* (2006.01)

(52) U.S. Cl. ..... 347/16; 347/19; 347/101; 347/103; 347/104; 347/105

(58) Field of Classification Search ..... 347/16, 347/19, 101, 103–105
See application file for complete search history.

(56) References Cited

U.S. PATENT DOCUMENTS

2006/0098070 A1* 5/2006 Kumagai ..... 347/101
2007/0122225 A1 5/2007 Izuchi et al.
2007/0195145 A1* 8/2007 Yamashita et al. ..... 347/101

FOREIGN PATENT DOCUMENTS

JP 2007-145574 A 6/2007

* cited by examiner

*Primary Examiner* — Jason Uhlenhake
(74) *Attorney, Agent, or Firm* — Baker Botts L.L.P.

(57) ABSTRACT

An image recording apparatus including a recording head, a feeding mechanism feeding a recording medium such that a second surface is opposed to the head, a first-area determining portion determining a first area, a second-area determining portion determining a second area, a contact-position determining portion determining a contact position on a first surface at which position a roller contacts the first surface, a feed controller capable of controlling feeding of the medium such that where the second surface is opposed to the head, the recording on the second surface is implemented with the second area skipped, and a judging portion determining whether the contact position is included in the first area at the moment of initiation of a skip operation. The feed controller controls an acceleration or a speed at which the medium is fed in the skip operation, on the basis of the determination made by the judging portion.

11 Claims, 16 Drawing Sheets

IMAGE RECORDING APPARATUS

CROSS REFERENCE TO RELATED APPLICATION

The present application claims priority from Japanese Patent Application No. 2008-251642, which was filed on Sep. 29, 2008, the disclosure of which is herein incorporated by reference in its entirety.

BACKGROUND OF THE INVENTION

1. Field of the Invention

The present invention relates to an image recording apparatus which includes a recording head for ejecting ink droplets onto a recording medium to record an image thereon, and is capable of recording an image on both of two opposite surfaces of a recording medium.

2. Description of Related Art

There is widely known an image recording apparatus of inkjet type having a recording head, from which ink droplets are ejected onto a recording medium while the recording medium is intermittently fed and passing an image recording position, so as to record an image thereon. There is known a kind of such an image recording apparatus that is capable of recording an image on both opposite surfaces of a recording medium. This image recording apparatus operates such that a recording medium is first supplied from a tray into a feed path by means of a pickup roller, and then fed along the feed path by a feeder roller to the recording position, where an image is recorded on a first one of two opposite surfaces of the recording medium. Thereafter, the recording medium is fed back onto the tray so as to be again supplied into the feed path by the pickup roller and fed to the image recording position by the feeder roller. At the image recording position, an image is again recorded on the recording medium, this time on a back side, i.e., a second surface, of the recording medium opposite to the first surface.

When an inkjet image recording apparatus records an image based on image data on a recording surface of a recording medium, it is known to reduce a time required to record the image across the entire recording surface, by a skip operation. It is noted that the no-image area corresponds to a non-recording area where no image exists in an image as actually formed or recorded on a recording surface based on the image data. The other part of the image data than the no-image area corresponds to an image area, and the other part on the recording surface than the non-recording area corresponds to a recording area. More specifically, the recording medium is fed continuously while a non-recording area on the recording medium is passing the image recording position. When an entirety of the non-recording area has passed the image recording position, that is, when a next leading end, in a direction of feeding of a recording medium, of a recording area on the recording surface reaches the image recording position, the feeding of the recording medium is switched from continuous to intermittent, so as to record an image across the recording area during the recording medium is intermittently fed.

The image recording apparatus capable of recording an image on both surfaces of a recording medium suffers from the following problem. That is, during recording of an image on a second surface of a recording medium, it can occur that the pickup roller is in contact with a first surface of the recording medium at the moment when feeding of the recording medium is switched from intermittent to continuous so as to skip a non-recording area on the second surface. When this occurs, the pickup roller may be unable to rotate following an abrupt acceleration of the recording medium, and slip on the recording medium. When the pickup roller slips in this way, the ink forming an image on the first surface may transfer or adhere to an outer circumferential surface of the pickup roller. Such transfer of the ink results in contamination of the outer circumferential surface of the pickup roller as well as possible degradation of the quality of the image having been recorded on the first surface.

SUMMARY OF THE INVENTION

This invention has been developed in view of the above-described situations, and it is an object of the invention, therefore, to provide an image recording apparatus which controls an acceleration or a speed at which a recording medium is fed when a roller is in contact with a recording area on a first surface of the recording medium, in order to prevent slippage of the roller on the first surface that leads to contamination of an outer circumferential surface of the roller as well as possible degradation of an image recorded on the first surface.

To attain the above object, the invention provides an image recording apparatus including a recording head, a feeding mechanism, a first-area determining portion, a second-area determining portion, a contact-position determining portion, a feed controller, and a judging portion. The recording head ejects ink droplets onto a recording medium so as to record an image. The feeding mechanism feeds a recording medium on a first surface of which an image has been recorded, such that a second surface of the recording medium opposite to the first surface is opposed to the recording head. The first-area determining portion determines a first area based on an image density distribution of the first image data to be recorded on the first surface. The first area has an image density value not lower than a predetermined threshold. The second-area determining portion determines a second area at which recording of an image on the second surface is not implemented, based on a no-image area of second image data to be recorded on the second surface. The contact-position determining portion determines a contact position on the first surface at which position a roller rotated by contact thereof with the first surface contacts the first surface, where the second surface is opposed to the recording head. The feed controller controls feeding of the recording medium by the feeding mechanism, and is capable of controlling the feeding of the recording medium such that where the second surface is opposed to the recording head, the recording of the image on the second surface is implemented with the second area skipped. The judging portion determines whether the contact position determined by the contact-position determining portion is included in the first area at the moment of initiation of a skip operation of the second area. The feed controller controls an acceleration or a speed at which the recording medium is fed in the skip operation, on the basis of a result of the determination made by the judging portion.

BRIEF DESCRIPTION OF THE DRAWINGS

The above and other objects, features, advantages and technical and industrial significance of the present invention will be better understood by reading the following detailed description of one preferred embodiment of the invention, when considered in connection with the accompanying drawings, in which.

DETAILED DESCRIPTION OF PREFERRED EMBODIMENTS

Figure 1:
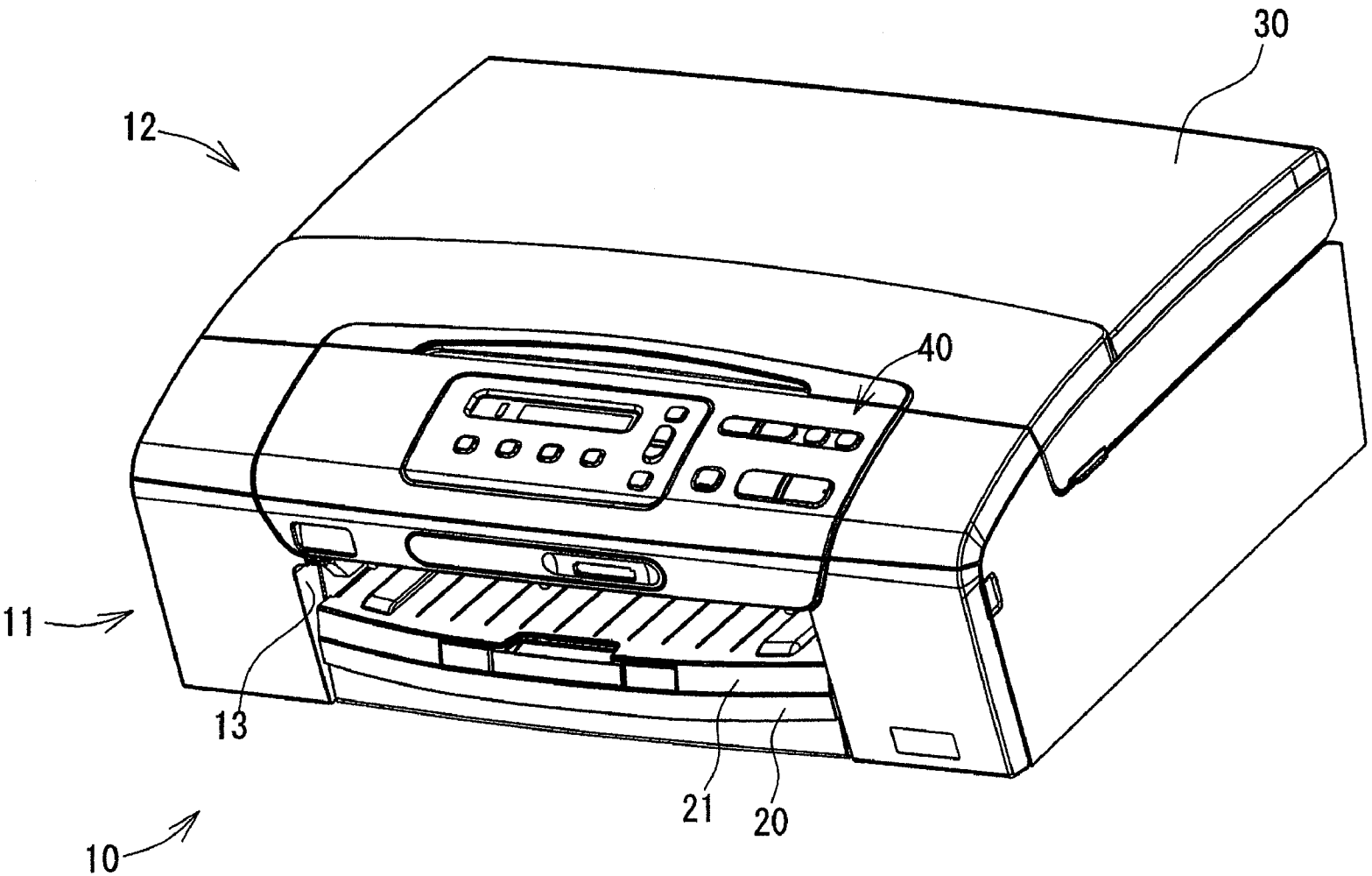
FIG. 1 is an external perspective view of a multifunction apparatus according to one embodiment of the invention.

In FIG. 1, reference numeral 10 generally denotes a multifunction apparatus as one embodiment of an image recording apparatus according to the invention. The multifunction apparatus 10 has various functions such as facsimile function, printer function, scanner function, and copy function. The functions other than the printer function may be omitted. For instance, the invention is applicable to a printer having only the printer function, and not having the scanner, copy and facsimile functions. As the printer function, the multifunction apparatus 10 has a double-side print function that enables printing of an image on both of two opposite surfaces of a recording sheet as a recording medium, first on a first one of the two opposite surfaces and then on a second one of the two opposite surfaces.

The multifunction apparatus 10 is mainly constituted by a printer portion 11, a scanner portion 12, and an operator panel 40. The printer portion 11 and the scanner portion 12 respectively constitute a lower portion and an upper portion of the multifunction apparatus 10. The operator panel 40 is disposed in a front upper portion of the multifunction apparatus 10. The printer portion 11 can function to record by an inkjet recording method an image on both of two opposite surfaces of a recording sheet.

At a front side of the printer portion 11, an opening 13 is formed, through which a sheet supply tray 20 (corresponding to a tray) and a catch tray 21 (corresponding to an ejection portion) are detachably inserted into the printer portion 11. In the printer portion 11, the sheet supply tray 20 is disposed under the catch tray 21. On the sheet supply tray 20, a stack of recording sheets can be placed. Recording sheets stacked on the supply tray 20 are one by one supplied into the printer portion 11, in order that a desired image is recorded on one or both of the surfaces of each recording sheet. The recording sheet on which recording of an image or images is complete is ejected onto the catch tray 21.

The scanner portion 12 is formed as a flatbed scanner. On the upper side of the scanner portion 12 is disposed a document cover 30 which constitutes a top plate of the multifunction apparatus 10. Under the document cover 30 is disposed a platen glass (not shown), on which a document is to be placed so as to be read by the scanner portion 12 while covered by the document cover 30.

The operator panel 40 allows a user to operate or control the printer and scanner portions 11, 12. The operator panel 40 has various manual operation buttons and a liquid crystal display. Through manipulation of the operator panel 40, the user can make settings of various functions, and implement various operations. For instance, the user can input through the operator panel 40 an instruction to set the kind of recording sheet to be used (e.g., regular paper or postcard), the desired operation mode (a single-side print mode or a double-side print mode), and the desired resolution (draft mode or photo mode). In the single-side print mode, an image is recorded on only one of the two opposite sides of each recording sheet, which will be hereinafter referred to as "the first surface". In the double-side print mode, an image is recorded on both of the two opposite surfaces of each recording sheet. One of the two opposite surfaces of each recording sheet on which an image is recorded first will be referred to as a first surface of the recording sheet. The other of the two opposite surfaces opposite to the first surface, on which an image is recorded after the recording of the image on the first surface, will be referred to as a second surface of the recording sheet.

Figure 2:
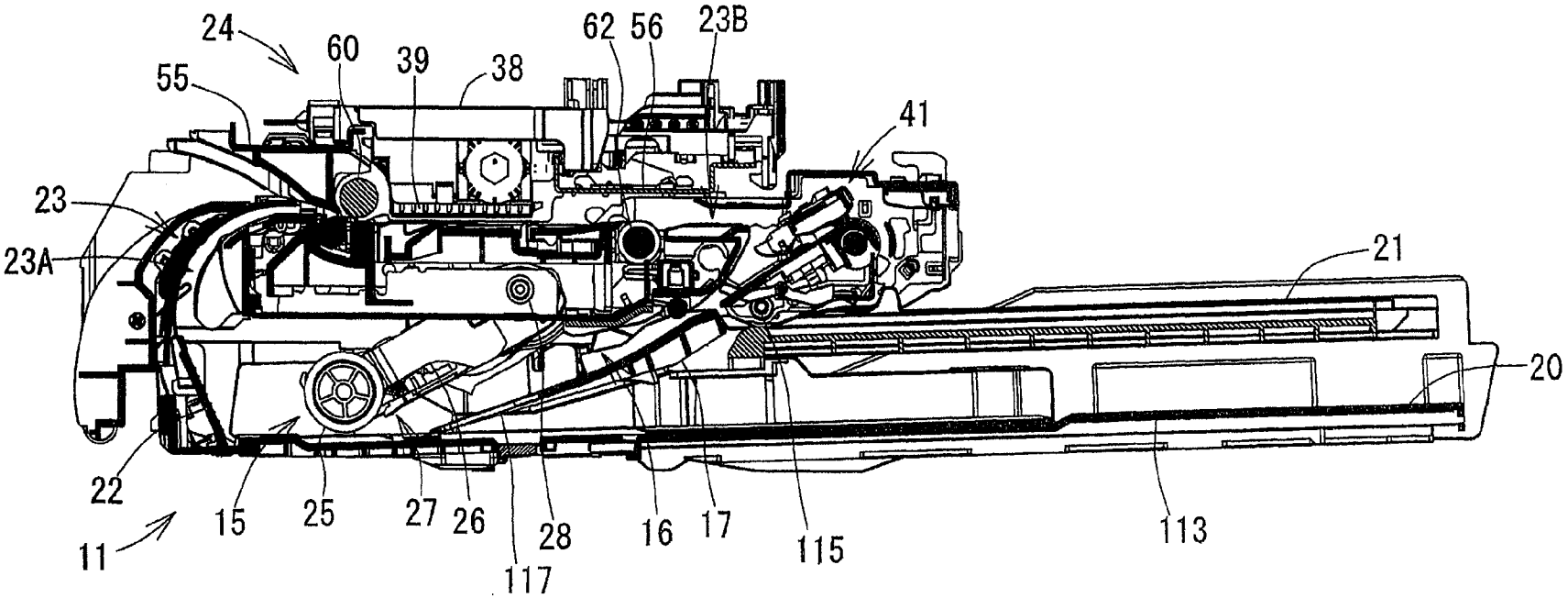
FIG. 2 is a vertical cross-sectional view showing a structure of a printer portion of the multifunction apparatus.

Referring to FIG. 2 which is a vertical cross-sectional view of the printer portion 11, there will be briefly described the printer portion 11. The printer portion 11 is mainly constituted by the sheet supply tray 20 on which recording sheets can be stacked, a pickup portion 15, a feed path 23, a feeding mechanism, a recording portion 24, the catch tray 21 onto which the recording sheet is ejected, a path switching portion 41, and a reverse guide path 16. The pickup portion 15 operates to one by one supply the recording sheets on the sheet supply tray 20. Each supplied recording sheet proceeds or is fed along the feed path 23. The feeding mechanism is suitably disposed in the feed path 23, and includes a feeder roller 60 (described later). The recording portion 24 operates to record an image on the recording sheet fed along the feed path 23, by ejecting ink droplets onto the recording sheet. The path switching portion 41 is disposed between the recording portion 24 and the catch tray 21, and operates to switch the path along which the recording sheet is fed so as to record an image on the second surface of the recording sheet opposite to the first surface. The reverse guide path 16 guides the recording sheet whose path has been switched by the path switching portion 41, toward the pickup portion 15 and the feed path 23.

The sheet supply tray 20 is disposed below the pickup portion 15 and at the bottom of the printer portion 11. The sheet supply tray 20 has a shape like a rectangular box open at the upper side. The sheet supply tray 20 has a bottom plate 113 providing a surface on which a stack of recording sheets is placed. That is, a plurality of recording sheets are stacked on the bottom plate 113. Recording sheets stacked on the sheet supply tray 20 are supplied or fed into the feed path 23 by a pickup roller 25 (corresponding to a roller) of the pickup portion 15.

The catch tray 21 is disposed over the sheet supply tray 20. At an end (on the left side as seen in FIG. 2) of the catch tray 21, a flap 17 is attached. The flap 17 cooperates with a first guide member 34 and a second guide member 35 (both shown in FIG. 3 and described later) to constitute the reverse guide path 16.

In the printer portion 11, in a case where an image is to be recorded on only the first surface of a recording sheet, the recording sheet as supplied by the pickup roller 25 into the feed path 23 is fed upward from the lower side along the feed path 23 and in a U-turn manner, to the recording portion 24 by which an image is recorded on the first surface of the recording sheet. Then, the recording sheet is ejected onto the catch tray 21.

On the other hand, where an image is to be recorded on both of the first and second surfaces of a recording medium, an image is first recorded by the recording portion 24 on the first surface, and then the recording sheet is guided by the path switching portion 41 into the reverse guide path 16 such that the first surface comes to contact the pickup roller 25 in order that the recording sheet is again supplied into the feed path 23 by the pickup roller 25. When the recording sheet thereafter reaches the recording portion 24, the recording portion 24 again records an image on the recording sheet, but this time on the second surface thereof. Then, the recording sheet is ejected onto the catch tray 21.

The recording portion 24 is disposed along the feed path 23, and includes a carriage 38 and a recording head 39 mounted on the carriage 38. The recording head 39 is reciprocated along guide rails 55, 56 in a main scanning direction perpendicular to a surface of the sheet on which FIG. 2 is represented. While the recording head 39 is reciprocated in such a way, an ink supplied from an ink cartridge (not shown) is ejected in the form of minute droplets onto a recording sheet being fed over a platen 42 (shown in FIGS. 4 and 5) so as to form an image on the recording sheet.

Figure 3:
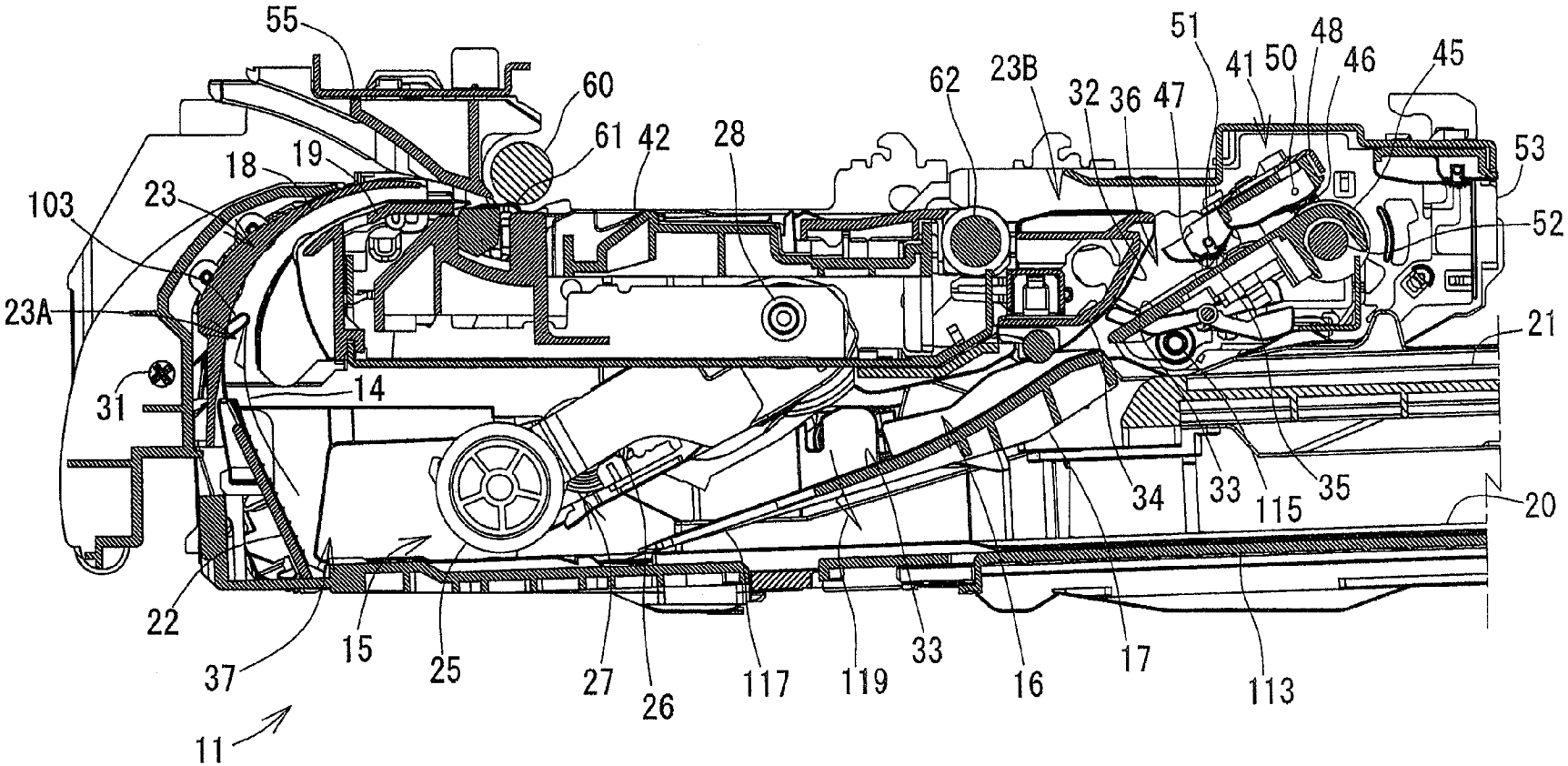
FIG. 3 is a vertical cross-sectional view showing a part of the printer portion in enlargement.

Referring further to FIG. 3, there will be described in more detail the printer portion 11. FIG. 3 is a cross-sectional view showing in enlargement a part of the printer portion 11. In FIG. 3, the recording portion 24 is not shown for convenience of illustration.

The pickup portion 15 includes the pickup roller 25, a pickup arm 26, and a drive transmitting device 27. The pickup roller 25 is disposed over the sheet supply tray 20, and serves to supply or feed into the feed path 23 recording sheets stacked on the sheet supply tray 20. The pickup roller 25 is supported at a distal end of the pickup arm 26 such that the pickup roller 25 is rotatable. The pickup roller 25 is driven or rotated by a SF (Sheet Feed) motor 73 (shown in FIGS. 6 and 8) as a drive source, via the drive transmitting device 27 including a plurality of gears in engagement with one another and arranged in an almost straight line.

The pickup roller 25 is provided with a first rotary encoder 86 (shown in FIG. 8) which includes an encoder disc (not shown) and an optical sensor. The encoder disc is rotated with the pickup roller 25 and has a pattern thereon, and the optical sensor detects the pattern on the encoder disc. Rotation of the pickup roller 25 is controlled by a control unit 84 (described later) based on a detection signal outputted from the optical sensor and indicative of the detected pattern.

A proximal end portion of the pickup arm 26 is supported by a pivot shaft 28 such that the pickup arm 26 is rotatable about the pivot shaft 28. Hence, the pickup arm 26 is vertically movable toward and away from the sheet supply tray 20. The pickup arm 26 is biased downward, or to rotate downward, by its own weight or a member such as a spring. Thus, the pickup arm 26 is normally held in contact with an upper surface of a topmost one of the recording sheets stacked on the sheet supply tray 20. The pickup arm 26 retracts upward when the sheet supply tray 20 is inserted into and pulled out from the printer portion 11.

When recording sheets are to be supplied from the sheet supply tray 20, the pickup roller 25 is rotated while biased downward in pressing contact with the topmost recording sheet on the sheet supply tray 20. This generates a frictional force between an outer circumferential surface of the pickup roller 25 and the topmost recording sheet, and the frictional force feeds the topmost recording sheet toward the feed path 23, i.e., leftward as seen in FIG. 3.

A leading edge of a recording sheet fed into the feed path 23 comes into contact with a slant separating plate 22 disposed on the sheet supply tray 20. By the contact with the slant separating plate 22, the recording sheet is guided upward into the feed path 23 in a direction indicated by an arrow 14. When the topmost recording sheet is fed out into the feed path 23, another recording sheet or sheets immediately under the topmost recording sheet may be together fed out by effect of friction or electrostatic. However, such a recording sheet or sheets supplied together with the topmost recording sheet is/are inhibited from being fed further from the slant separating plate 22 by its/their contact with the slant separating plate 22.

The feed path 23 includes a curving path 23A extending between the pickup roller 25 and the recording portion 24, and an ejection path 23B extending from the recording portion 24 to the catch tray 21. The curving path 23A extends in a U-turn manner from the pickup roller 25. That is, after extending to the slant separating plate 22, the curving path 23A extends upward and then frontward (i.e., rightward as seen in FIG. 3) to the recording portion 24. The ejection path 23B extends from the recording portion 24 substantially straight to the catch tray 21, from the rear side (i.e., the left side as seen in FIG. 3) of the multifunction apparatus 10 to the front side thereof.

The feed path 23 is defined between an outer guide surface and an inner guide surface, except at a place where the recording portion 24 is disposed. For instance, the curving path 23A at the rear side of the multifunction apparatus 10 is formed by fixing an outer guide member 18 and an inner guide member 19 on a mainbody frame 53 of the multifunction apparatus 10. That is, in this embodiment, the outer guide member 18 and the inner guide member 19 provide the outer and inner guide surfaces, respectively. The outer and inner guide members 18, 19 are disposed such that the two guide members 18, 19 are opposed to each other with a spacing interval therebetween.

At a position along the feed path 23 and downstream of the pickup roller 25 and upstream of the recording portion 24, there is disposed a pair of rollers, namely, a feeder roller 60 and a pinch roller 61. The pinch roller 61 is disposed below the feeder roller 60 in pressing contact with the feeder roller 60. The feeder and pinch rollers 60, 61 nip therebetween a recording sheet as fed along the curving path 23A to feed the recording sheet to a position over the platen 42. The feeder roller 60 and the pinch roller 61 partly correspond to a feeding mechanism.

Along the fed path 23 and downstream of the recording portion 24 is disposed a pair of rollers, namely, an ejection roller 62 and a gear roller 63, that nip therebetween a recording sheet on which an image has been recorded to feed further downward toward the catch tray 21. The feeder roller 60 and the ejection roller 62 are rotated by a drive force from a LF (Line Feed) motor 71 (shown in FIG. 8).

The feeder roller 60 is provided with a second rotary encoder 87 (shown in FIG. 8) which includes an encoder disc (not shown) and an optical sensor. The encoder disc is rotated with the feeder roller 60 and has a pattern thereon, and the optical sensor detects the pattern. The optical sensor inputs to a control unit 84 (described later) a detection signal indicative of the detected pattern. Based on the detection signal from the optical sensor and an output signal from a registration sensor 102 (shown in FIGS. 6 and 7 and described later), the control unit 84 obtains an amount, speed, and angle of rotation of the feeder roller 60, and a position of a recording sheet in the feed path 23. Based on the thus obtained amount, speed, and rotation angle of the feeder roller and the position of a recording sheet in the fed path 23, the control unit 84 controls rotations of the feeder roller 60 and the ejection roller 62.

When a recording sheet supplied from the sheet supply tray 20 into the curving path 23A by the pickup roller 25 reaches the feeder roller 60 and the pinch roller 61, the recording sheet is nipped between the feeder and pinch rollers 60, 61 and fed along the curving path 23A toward the position over the platen 42 of the recording portion 24 such that the recording sheet is oriented over the platen 42 such that one of two opposite surfaces of the recording sheet, which is opposite to a surface thereof in contact with the pickup roller 25 when the recording sheet is fed out into the curving path 23A, is opposed to the recording head 39 of the recording portion 24.

The feeder roller 60 and ejection roller 62 are rotated by the LF motor 71 as a drive source in synchronization with each other. When an image is being recorded, the control unit 84 controls the feeder and ejection rollers 60, 62 to rotate intermittently. Thus, an image is recorded while the recording sheet is intermittently fed. Before and after the recording of the image, the control unit 84 controls the feeder and ejection rollers 60, 62 to continuously rotate so as to feed the recording sheet continuously, in order to enhance the speed or rate of feeding of the recording sheet in the recording of an entirety of the image.

According to the present embodiment, continuously feeding a recording sheet, in other words, to control by the control unit 84 the feeder and ejection rollers 60, 62 to continuously rotate, is implemented not only before and after recording of an image across an entire recording surface, but may be implemented also while a recording sheet is present over the platen 42 for recording of an image thereon, as long as a predetermined condition is established. For instance, consider a case of FIG. 13A where an image is recorded only in a recording area 131A on a recording sheet 131. The recording area 131A is located in an edge portion of a recording sheet 131 on the leading side with respect to the direction of feeding of the recording sheet 131 corresponding to a direction indicated by a white arrow (which will be hereinafter referred to as "the feeding direction"), and an image is recorded at the image recording area 131A while the recording sheet is being intermittently fed. When the recording of the image is performed through to a trailing end P10 of the recording area 131A, feeding of the recording sheet 131 is switched from intermittent to continuous. In other words, even while a portion of the recording sheet 131 is opposed to the recording head 39, as long as the portion corresponds to a non-recording area 131B on the recording sheet 131, which is downstream of the recording area 131A in the feeding direction in this case, the recording sheet 131 is "skipped" since there is no image desired to be recorded at the non-recording area 131B. That is, the recording of an image on the recording sheet 131 is not implemented while the non-recording area 131B is passing an image recording position, which is a position where ink droplets are ejected from the recording head 39 onto the recording medium. On the other hand, consider a case of FIG. 13B where an image is recorded in each of two edge portions of a recording sheet 132 on the leading and trailing sides, but an image is not recorded at a central portion in the same direction of the recording sheet 132. In this case, initially an image is recorded at a recording area 132A in the leading edge portion of the recording sheet 132 while the recording sheet 132 being is intermittently fed, and when the recording is performed through to a trailing end P 20 of the recording area 132A, feeding of the recording sheet 132 is switched from intermittent to continuous. Then, the recording sheet 132 is fed continuously until a leading end P21 of a next recording area 132C in the trailing edge portion of the recording sheet 132 reaches the image recording position. In other words, a non-recording area 132B in the central portion of the recording sheet 132 is skipped. This enables to feed a recording sheet at high speed or rate not only before and after recording of an image across a recording surface of the recording sheet but even during the image recording. This control of sheet feeding will be described in detail later, by referring to flowcharts of FIGS. 9-11. Hereinafter, continuously feeding a recording sheet while a non-recording area is passing the image recording position will be referred to as "the skip feed".

At a position upstream of the feeder roller 60 in the curving path 23A, a rotatable member 103 is disposed such that the rotatable member 103 protrudes from the outer guide member 18 into and across the curving path 23A. The rotatable member 103 cooperates with a detector element 104 and a photo-interrupter 105 to constitute a registration sensor 102 (shown in FIGS. 6 and 7) for detecting the position of a leading edge of a recording sheet in the curving path 23A. The detector element 104 is disposed on a support shaft 31. The registration sensor 102 will be fully described later.

Two opposite ends of the reverse guide path 16 are respectively connected to the ejection path 23B and the curving path 23A of the feed path 23. More specifically, the reverse guide path 16 is formed to extend from a downstream portion 36 of the ejection path 23B or of the feed path 23 to an upstream portion 37 of the curving path 23A or of the feed path 23, via a position on the sheet supply tray 20. The downstream portion 36 is located on the downstream side of the recording portion 24. The upstream portion 37 of the curving path 23A positionally corresponds to the slant separating plate 22 and its vicinity, and serves as an entrance of the curving path 23A. The reverse guide path 16 directs a recording sheet on which an image has been recorded, again to the position on the sheet supply tray 20.

The reverse guide path 16 is defined between a first guide surface 32 and a second guide surface 33. The first guide surface 32 is provided by a surface of the first guide member 34 disposed inside the mainbody frame 53 of the multifunction apparatus 10. The second guide surface 33 is provided by a surface of the second guide member 35 and a surface of the flap 17. The second guide member 35 is disposed inside the mainbody frame 53, and the flap 17 is pivotably supported on the catch tray 21. The first and second guide members 34, 35 are opposed to each other with a spacing interval therebetween. The first guide member 34 and the flap 17 are also opposed to each other with a spacing interval therebetween. The first and second guide surfaces 32, 33 extend obliquely downward from a downstream portion of the feed path 23, or the downstream portion of the ejection path 23B, toward the pickup roller 25.

In this embodiment the reverse guide path 16 extends in order to feed the recording sheet with an image having been recorded on a first surface thereof, back onto the sheet supply tray 20. However, the form of the reverse guide path 16 is not limited thereto, but may be anywise as long as the reverse guide path 16 can connect the downstream portion 36 of the feed path 23 to the upstream portion 37 thereof. That is, the recording sheet with an image having been recorded on the first surface thereof may be fed from the downstream portion 36 back to the upstream portion 37 through a path other than the reverse guide path 16.

Figure 6:
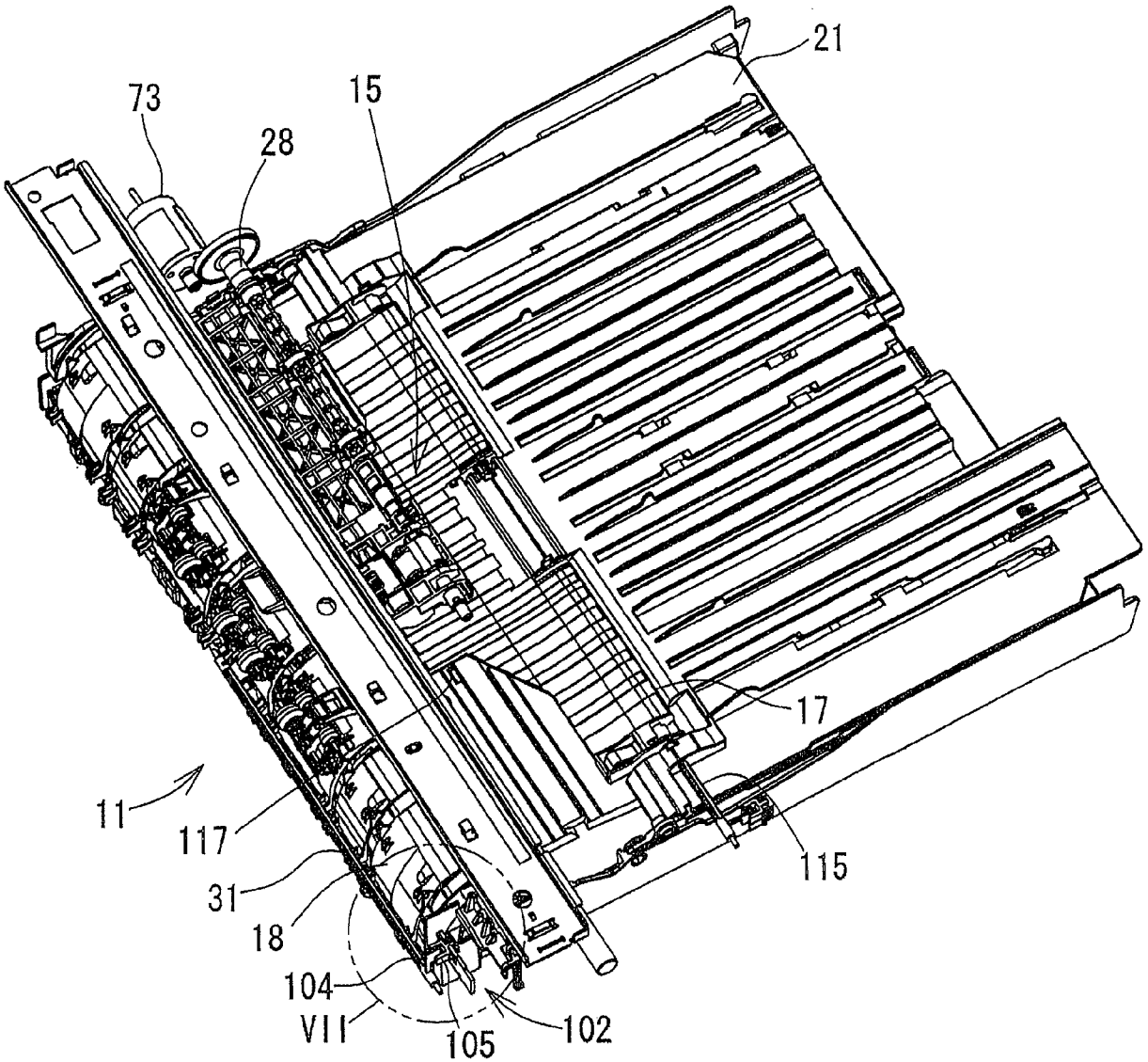
FIG. 6 is an internal perspective view of the printer portion.

The flap 17 is pivotable or swingable about a support shaft 115 that is pivotably supported at an end of the catch tray 21. At a center in a width direction of the sheet supply tray 20 (i.e., the direction perpendicular to a surface of the sheet on which FIG. 3 is presented), the flap 17 protrudes obliquely downward toward the bottom plate 113 of the sheet supply tray 20. This central protruding portion of the flap 17 is shown in FIG. 6 and denoted by reference numeral 117. In a state where no recording sheets are on the sheet supply tray 20, the protruding portion 117 reaches the bottom plate 113.

The flap 17 is biased by its own weight, or a torsion coil spring (not shown) disposed on the support shaft 115, to swing in a direction indicated by arrow 119 in FIG. 3, i.e., toward the bottom plate 113 of the sheet supply tray 20, in order that an end of the flap 17 is held in contact with the topmost one of the recording sheets on the sheet supply tray 20. Hence, the stack of recording sheets on the sheet supply tray 20 receives a downward pressing force from the flap 17. With the pressing force from the flap 17 acting on the recording sheets on the sheet supply tray 20, even where a leading edge portion of a recording sheet fed back onto the sheet supply tray 20 after fed through the reverse guide path 16 is curled, the curled portion of the recording sheet is flattened by the flap 17. It is noted that although the level or the vertical position of the topmost recording sheet on the sheet supply tray 20 varies according to the amount of the recording sheets stacked on the sheet supply tray 20, the shape and dimensions of the flap 17, the position where the flap 17 is supported, and other conditions are adjusted such that the end of the flap 17 is held in contact with the upper surface of the topmost recording sheet on the sheet supply tray 20 irrespective of the amount of the recording sheets stacked.

There will be described the path switching portion 41 disposed downstream of the recording portion 24. More specifically, the path switching portion 41 is disposed in the downstream portion 36 of the feed path 23 located downstream of the recording portion 24. At the downstream portion 36, the ejection path 23B is connected to the reverse guide path 16.

The path switching portion 41 includes a pair of rollers, namely, a first roller 45 and a second roller 46, and an auxiliary roller 47 juxtaposed to the second roller 46. The first and second rollers 45, 46 nip therebetween a recording sheet fed by and from the ejection and gear rollers 62, 63. The first and second rollers 45, 46 can feed the recording sheet either further to the downstream side, i.e., toward the catch tray 21, in the feeding direction along the ejection path 23B, or into the reverse guide path 16.

The second and auxiliary rollers 46, 47 are attached to a frame 48 extending in a lateral direction of the multifunction apparatus 10, i.e., in the direction perpendicular to the surface of the sheet on which FIG. 3 is presented. In cross section, the frame 48 has an L-like shape to ensure a required flexural rigidity.

More specifically, each of the second roller 46 and the auxiliary roller 47 is constituted by a plurality of rollers. The rollers collectively constituting the second and auxiliary rollers 46, 47, respectively, are arranged in the lateral or width direction of the multifunction apparatus 10 at predetermined intervals, and supported on shafts 50, 51 such that the rollers 46, 47 are rotatable about the shafts 50, 51. The shafts 50, 51 extend perpendicular to the surface of the sheet in which FIG. 3 is presented, and are disposed on the frame 48. Hereinafter, the rollers constituting the second roller 46 and the auxiliary roller 47, respectively, may be collectively referred to as "the second roller 46" and "the auxiliary roller 47". The second and auxiliary rollers 46, 47 that are to contact a recording surface of a recording sheet have a gear-like shape, like the gear roller 63 does. The auxiliary roller 47 is disposed upstream of the second roller 46 and spaced therefrom by a distance. The second roller 46 is biased onto the first roller 45 by an elastic member.

The first roller 45 is connected with and rotated by the LF motor 71 (shown in FIG. 8) as a drive source, via a drive transmitting mechanism (not shown). The first roller 45 has a shaft 52 supported on the mainbody frame 53.

The second roller 46 is disposed above the first roller 45. The first roller 45 may be constituted by a single thin columnar member, or may be constituted by a plurality of rollers respectively opposed to the rollers constituting the second roller 46. The first roller 45 is rotated by the LF motor 71 in either a forward direction or a reverse direction. A recording sheet fed from the recording portion 24 along the ejection path 23B is nipped between the first and second rollers 45, 46.

Figure 4:
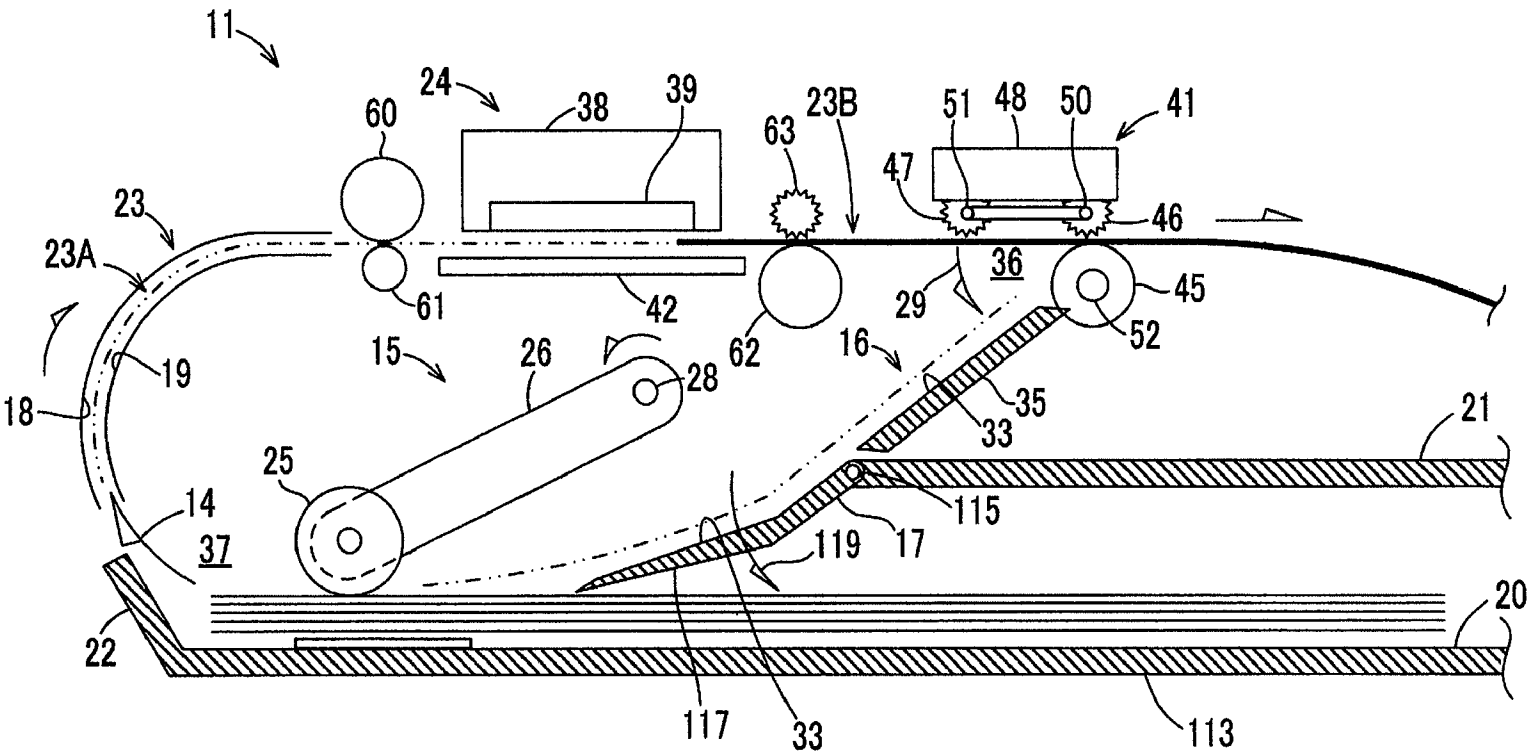
FIGS. 4 and 5 schematically illustrate an operation of a path switching portion of the printer portion.
Figure 5:
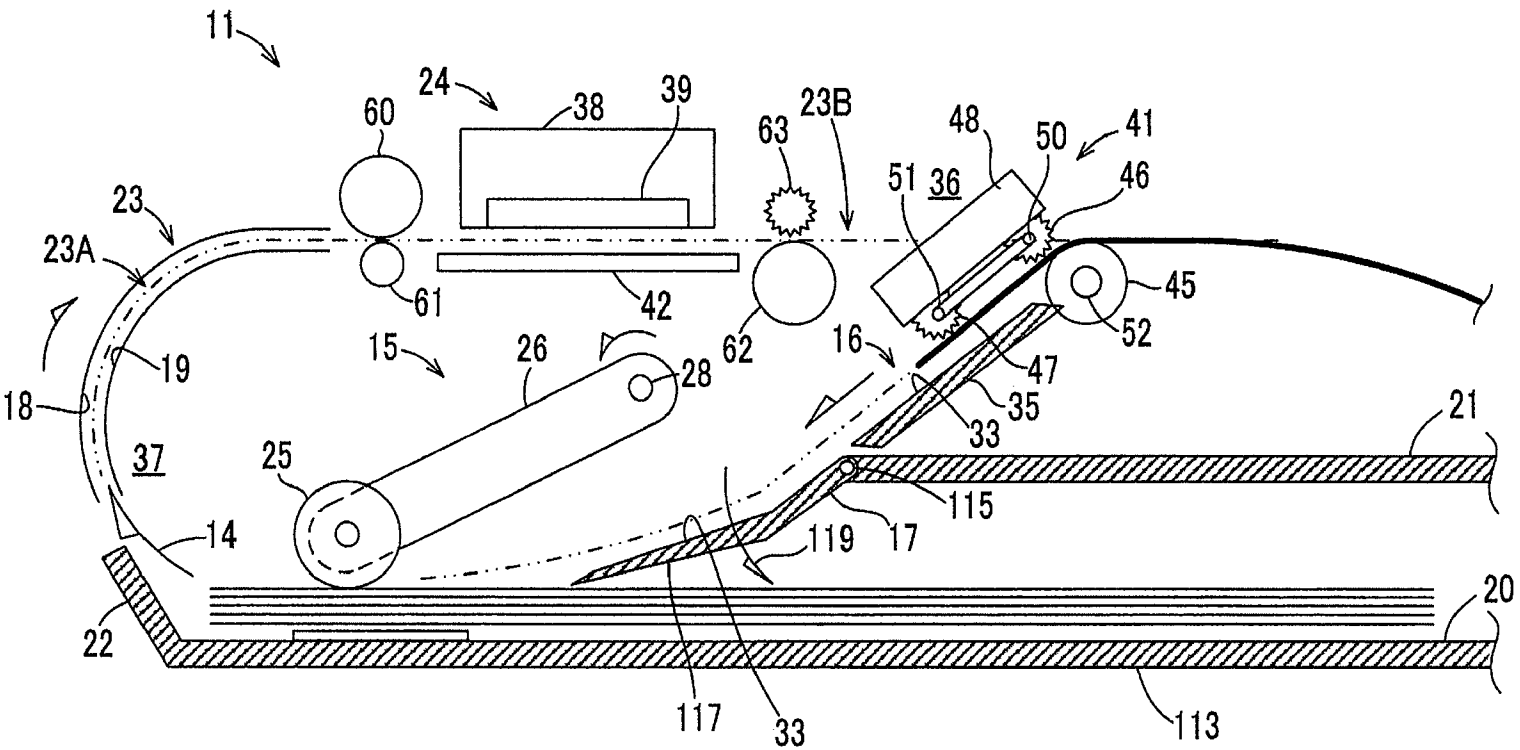

Referring next to FIGS. 4 and 5, which schematically illustrate an operation of the path switching portion 41 and in which the first guide member 34 is not shown, the path switching portion 41 is pivotable or rotatable about the shaft 52 such that the frame 48 and the second and auxiliary rollers 46, 47 are integrally or together swingable in a direction indicated by an arrow 29. The attitude or position of the path switching portion 41 varies depending on whether a drive force is transmitted to the path switching portion 41 from the LF motor 71 or not. More specifically, the path switching portion 41 is switchable between an ejecting position (shown in FIG. 4) for ejecting onto the catch tray 21 a recording sheet having passed the recording portion 24, and a reversing position (shown in FIG. 5) for guiding a recording sheet having passed the recording portion 24 into the reverse guide path 16 to reverse the recording sheet.

That is, when the first roller 45 is rotated by the LF motor 71 in the forward direction (i.e., the clockwise as seen in FIGS. 4 and 5), the path switching portion 41 is placed in its ejecting position, and a recording sheet having passed the recording portion 24 is fed toward the catch tray 21, i.e., rightward as seen in FIG. 4. Where a single-side print processing is implemented, the first roller 45 is kept rotated in the forward direction in order that the first and second rollers 45, 46 nip therebetween the recording sheet to feed the recording sheet to the downstream side and eject onto the catch tray 21, as shown in FIG. 4.

On the other hand, where a double-side print processing is implemented, the path switching portion 41 is switched in position from the ejecting position of FIG. 4 to the reversing position of FIG. 5, with the first and second rollers 45, 46 nipping therebetween a trailing edge portion of a recording sheet. This switch in the position of the path switching portion 41 is made by switching the rotation direction of the LF motor 71 to switch the rotation direction of the first roller 45 from the forward direction to the reverse direction which is counterclockwise as seen in FIGS. 4 and 5. When the position of the path switching portion 41 is switched to the reversing position, the trailing edge portion of the recording sheet is pressed downward by the auxiliary roller 47, and a force to feed the recording sheet toward the pickup roller 25 is imposed on the recording sheet from the first roller 45. Thus, the recording sheet with an image having been recorded on the first surface thereof by the recording portion 24 is fed into the reverse guide path 16 from the side of its trailing edge portion, in a switchback manner.

In this embodiment, while the first roller 45 rotates in the forward direction, a drive force of the SF motor 73 (shown in FIGS. 6 and 8) is transmitted to the pickup roller 25 via the pivot shaft 28, and while the first roller 45 rotates in the reverse direction, a drive force is not transmitted to the pickup roller 25. That is, while a recording sheet is fed along the reverse guide path 16 by the first roller 45 and others, a drive force of the SF motor 73 is not transmitted to the pivot shaft 28. Such an operation is realized by controlling the SF motor 73, which supplies a drive force to the pickup roller 25, independently of other motors that include the LF motor 71 and drive rollers other than the pickup roller 25 including the feeder roller 60. However, a drive transmitting system where a single common motor drives the pickup roller 25 as well as other rollers including the feeder roller 60 may be employed. Where such a drive transmitting system is employed, the above-described operation can be realized by employing a transmission switching mechanism such as one using a clutch and/or a planetary gear.

Figure 7:
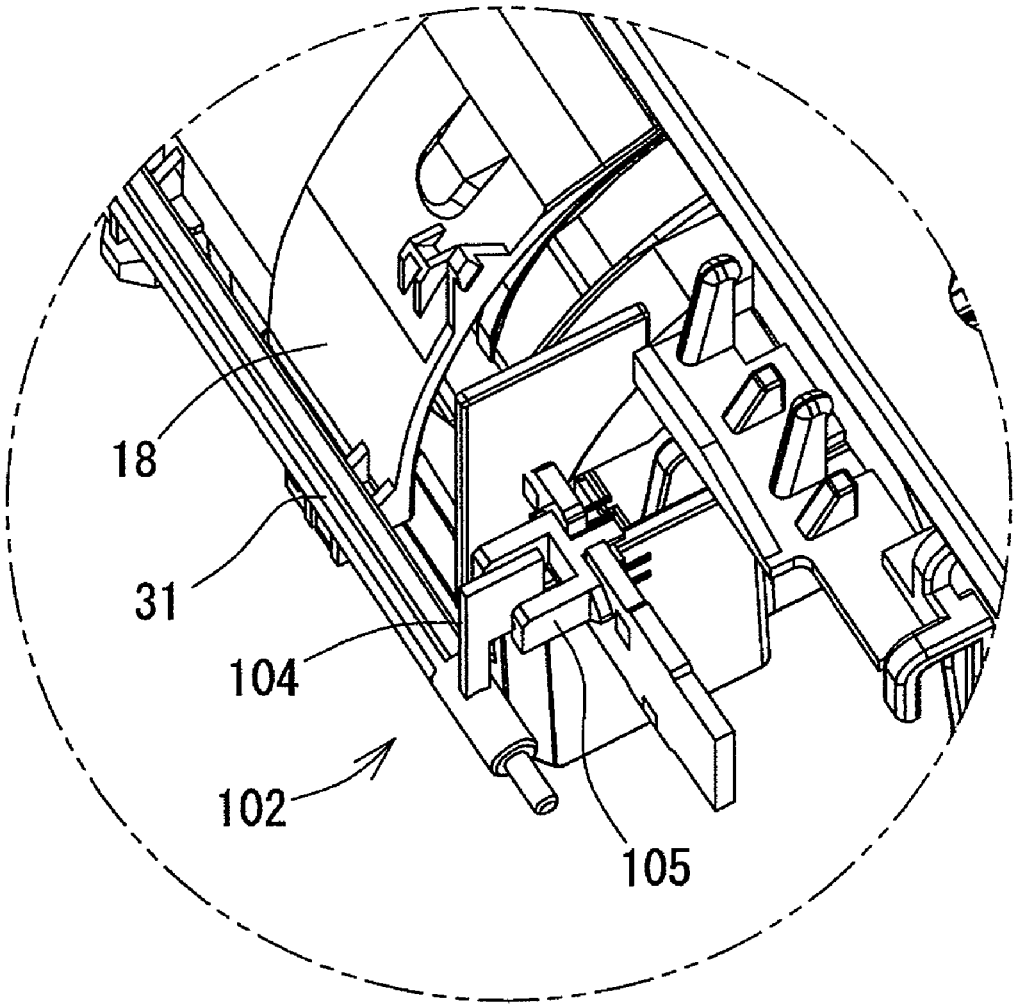
FIG. 7 is an enlarged view of a part of FIG. 6 encircled by broken line, showing in detail a registration sensor in the printer portion.

There will be described the registration sensor 102, referring to FIGS. 6 and 7, in which FIG. 6 is an internal perspective view of the printer portion 11, and FIG. 7 is an enlarged view of a part of FIG. 6 encircled by broken line, showing the registration sensor 102 in detail.

The registration sensor 102 includes the rotatable member 103 (shown in FIG. 3), the support shaft 31 supporting the rotatable member 103, the detector element 104, and the photointerrupter 105. As shown in FIG. 6, the support shaft 31 is disposed on the outer side of the outer guide member 18. More specifically, the support shaft 31 extends along the width direction of the multifunction apparatus 10 from an end of the outer guide member 18 to a vicinity of an intermediate portion of the outer guide member 18. The support shaft 31 is supported by the outer guide member 18 such that the support shaft 31 is rotatable. The rotatable member 103 is disposed on the support shaft 31 such that the rotatable member 103 retractably extends into the curving path 23A through a slit (not shown) formed in the outer guide member 18. That is, by rotating the support shaft 31, the rotatable member 103 can be made protruding into and retracted from the curving path 23A. In the embodiment, the support shaft 31 is elastically biased in such a direction that the rotatable member 103 is held protruding in the curving path 23A.

As shown in FIG. 7, the detector element 104 is disposed on an axial end portion of the support shaft 31 such that the detector element 104 protrudes perpendicular to an axial direction of the support shaft 31. The photointerrupter 105 is connected with the control unit 84 (shown in FIG. 8 and described later). The photointerrupter 105 has a light-emitting element and a light-receiving element that are disposed with a gap therebetween. In the embodiment, the photointerrupter 105 is disposed at a position such that the detector element 104 can be placed in and retracted from the gap between the light-emitting and light-receiving elements. More specifically, when the rotatable member 103 is in the position protruding in the curving path 23A, the detector element 104 is located in the gap so as to block light that is emitted from the light-emitting element and would otherwise travel through the gap to be incident on the light-receiving element. On the other hand, when the rotatable member 103 is in the position retracted from the curving path 23A into the outer guide member 18, the detector element 104 is retracted from the gap, whereby light emitted from the light-emitting element is not blocked by the detector element 104 and incident on the light-receiving element.

When a recording sheet comes into contact with the rotatable member 103 of the registration sensor 102 while being fed along the curving path 23A, the rotatable member 103 retracts from the curving path 23A into the outer guide member 18 and the detector element 104 retracts from the gap of the photointerrupter 105, resulting in a change in an output signal from the light-receiving element, based on which the control unit 84 determines a position of a recording sheet in the feed path 23.

Figure 8:
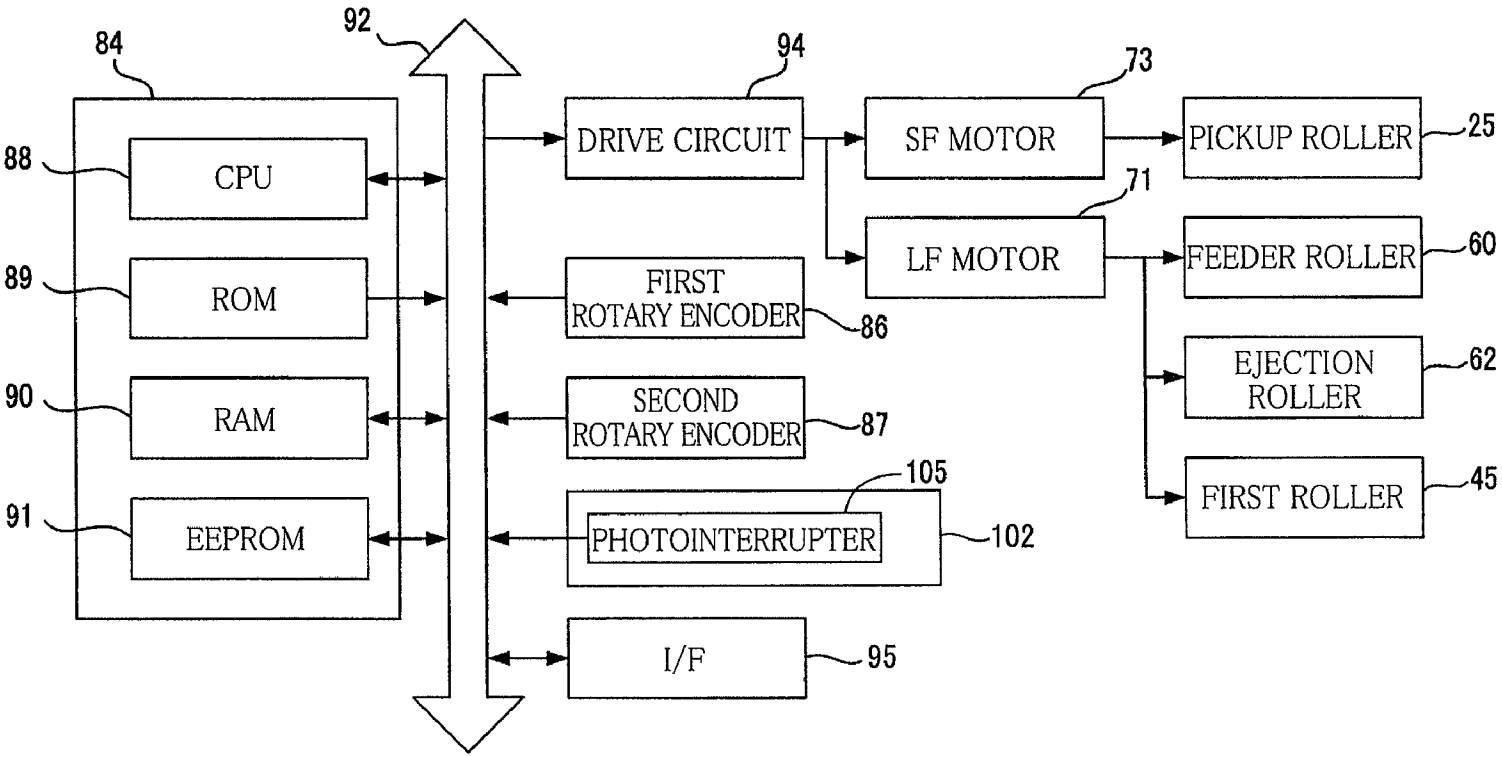
FIG. 8 is a block diagram of a control unit of the multifunction apparatus.

Referring to FIG. 8 which is a block diagram of the control unit 84, the control unit 84 of the multifunction apparatus 10 will be described. The control unit 84 generally controls operations of the multifunction apparatus 10. Here, however, only a part of the operations of the control unit 84 that is relevant to the invention will be illustrated, and a detailed description of the other part of the operations of the control unit 84 is dispensed with. It is noted that the control unit 84 includes portions corresponding to a feed controller, a first-area determining portion, a second-area determining portion, a contact-position determining portion, a judging portion, an ejection controller, and a limit-area determining portion.

The control unit 84 is constituted by a microcomputer mainly including a CPU 88, a ROM 89, a RAM 90, and an EEPROM 91. The control unit 84 is connected with various portions of the multifunction apparatus 10 via a bus 92.

Figure 9:
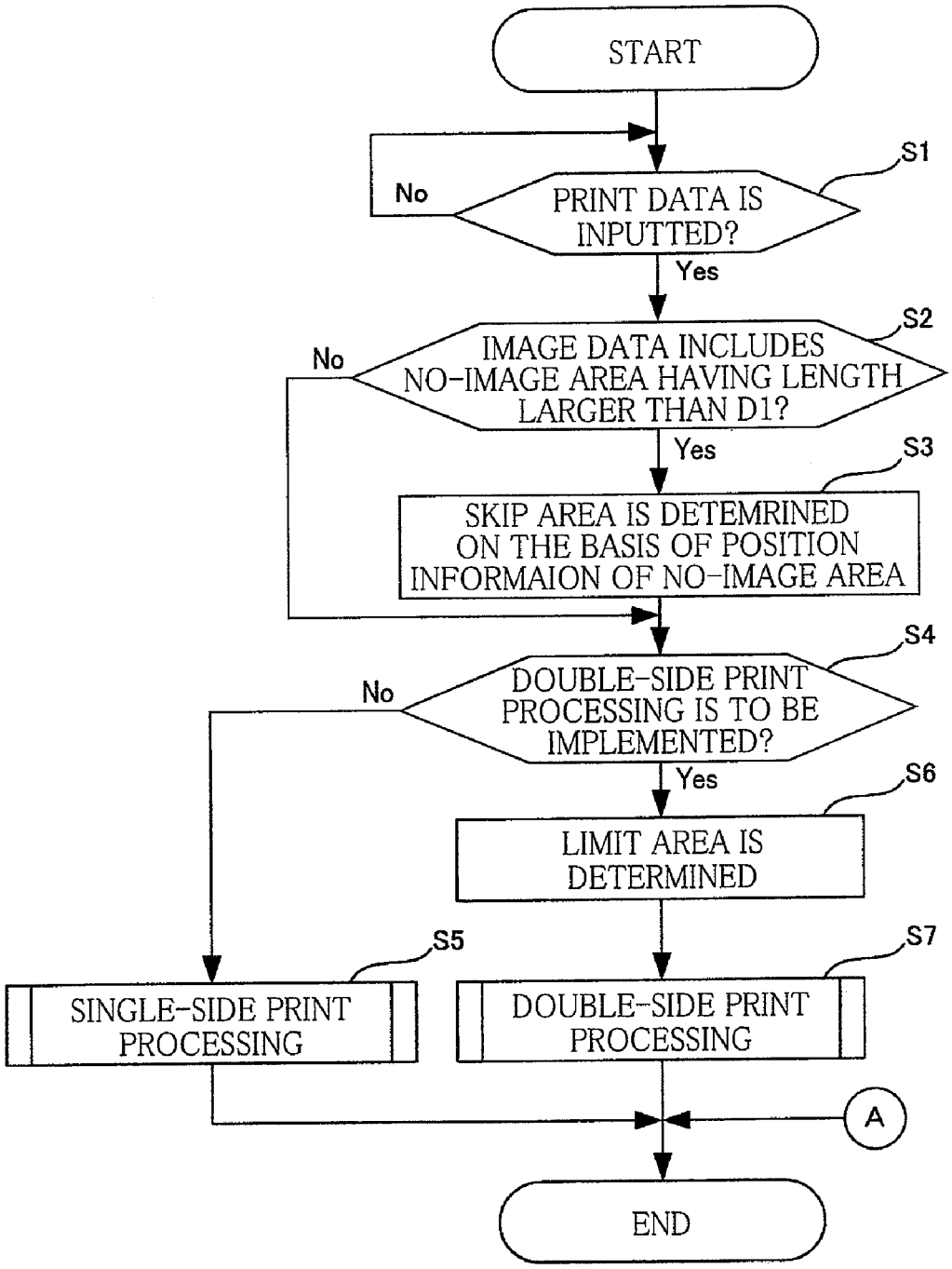
FIG. 9 is a flowchart illustrating a control operation executed by the control unit.

In the ROM 89 are stored programs and others for controlling various operations of the multifunction apparatus 10. For instance, the ROM 89 stores a control program according to which steps of a flowchart in FIG. 9 are implemented.

The RAM 90 is used as a temporary storage area for temporarily storing various kinds of data, and as a work area, when the CPU 88 executes the programs.

Figure 15A:
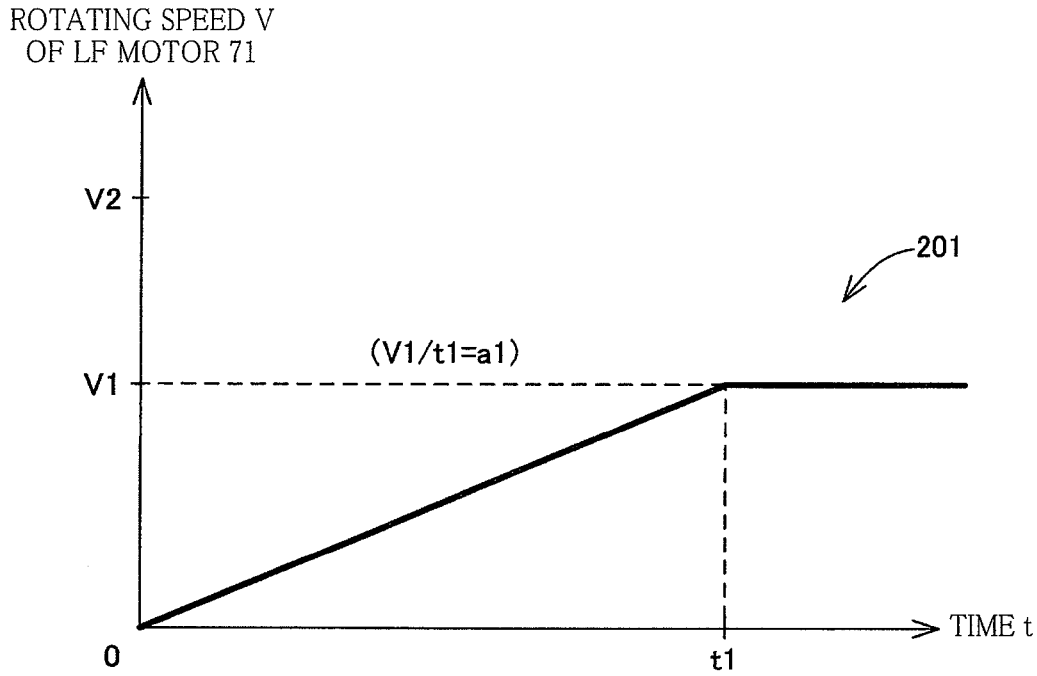
FIGS. 15A and 15B illustrate an example of speed profiles used in a skip feed of a recording sheet.
Figure 15B:
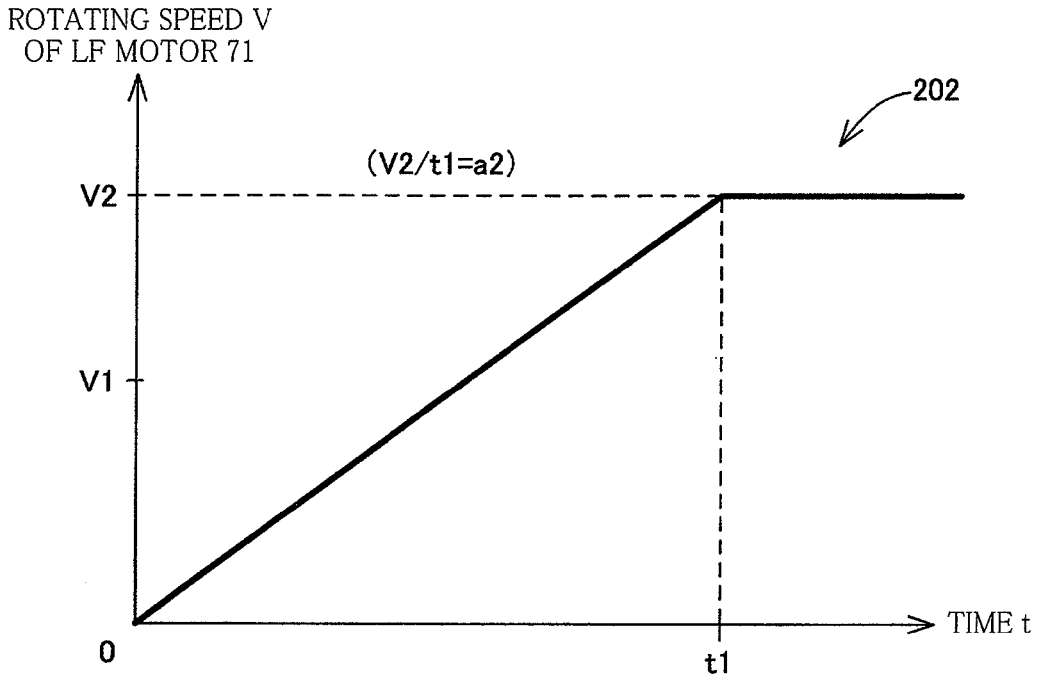

The EEPROM 91 stores data, set flags, and others that should be retained even after the multifunction apparatus 10 is turned off, and a plurality of speed profiles used in controlling the rotating speed of the LF motor 71. The speed profiles are namely first and second speed profiles 201 and 202 shown in FIGS. 15A and 15B that are used in implementing the skip feed described above and in ejecting a recording sheet. As shown in FIG. 15A, according to the first speed profile 201, the LF motor 71 is accelerated at a first acceleration value a1 such that the rotating speed of the LF motor 71 reaches a first speed value V1 at a time t1 at which the acceleration is terminated. As shown in FIG. 15B, according to the second speed profile 202, the LF motor 71 is accelerated at a second acceleration value a2, which is larger than the first acceleration value a1, such that the rotating speed of the LF motor 71 reaches a second speed value V2, which is larger than the first speed value V1, at the time t1 at which the acceleration is terminated. The control unit 84 uses the first and second speed profiles 201, 202 when feeding a recording sheet by the skip feed and when ejecting a recording sheet onto the catch tray 21. The first acceleration value a1 corresponds to a first feed acceleration value and a first ejection acceleration value, and the second acceleration value a2 corresponds to a second feed acceleration value and a second ejection acceleration value. The first speed value V1 corresponds to a first feed speed value and a first ejection speed value, and the second speed value V2 corresponds to a second feed speed value and a second ejection speed value.

The drive circuit 94 is for driving the LF motor 71 and the SF motor 73. The LF motor 71 is connected with the feeder roller 60, the ejection roller 62, and the first roller 45. The SF motor 73 is connected with the pickup roller 25. The drive circuit 94 has drivers for driving the LF motor 71 and the SF motor 73, respectively. That is, the LF and SF motors 71, 73 are controlled independently of each other. The drive circuit 94 receives a phase excitation signal outputted from the CPU 88, and generates an electrical signal or a driving current for rotating the LF motor 71 or the SF motor 73. Upon receiving the electrical signal, the LF motor 71 or the SF motor 73 rotates, and this rotation of the LF or SF motor 71, 73 is transmitted to the feeder, ejection and first rollers 60, 62, 45, or to the pickup roller 25, via a known driving mechanism.

Thus, in the multifunction apparatus 10, the LF motor 71 serves as a drive source for feeding a recording sheet in the curving path 23A and over the platen 42, and in the case where recording on a recording sheet is complete and the recording sheet is to be ejected onto the catch tray 21, in the ejection path 23B also. The LF motor 71 further serves as a drive source for rotating the ejection roller 62 via a drive transmitting mechanism (not shown), and as a drive source for switching the position of the path switching portion 41 from one of the ejecting position (shown in FIG. 5) and the reversing position (shown in FIG. 6) to the other via a planetary gear and/or others.

With the bus 92 are connected the registration sensor 102 for detecting the leading edge of a recording sheet as supplied into the curving path 23A by the pickup roller 25, the second rotary encoder 87 for detecting a rotation amount of the feeder roller 60 and others driven by the LF motor 71, an interface (I/F) 95 for connecting the multifunction apparatus 10 with an external apparatus such that data communication therebetween is possible, the first rotary encoder 86 for detecting a rotation amount of the pickup roller 25 driven by the SF motor 73, and others. The control unit 84 obtains the position of a leading or trailing edge of a recording sheet and an amount of feeding of the recording sheet, on the basis of the output signal from the registration sensor 102 and the amounts of rotation detected by the rotary encoders 86, 87.

Figure 10:
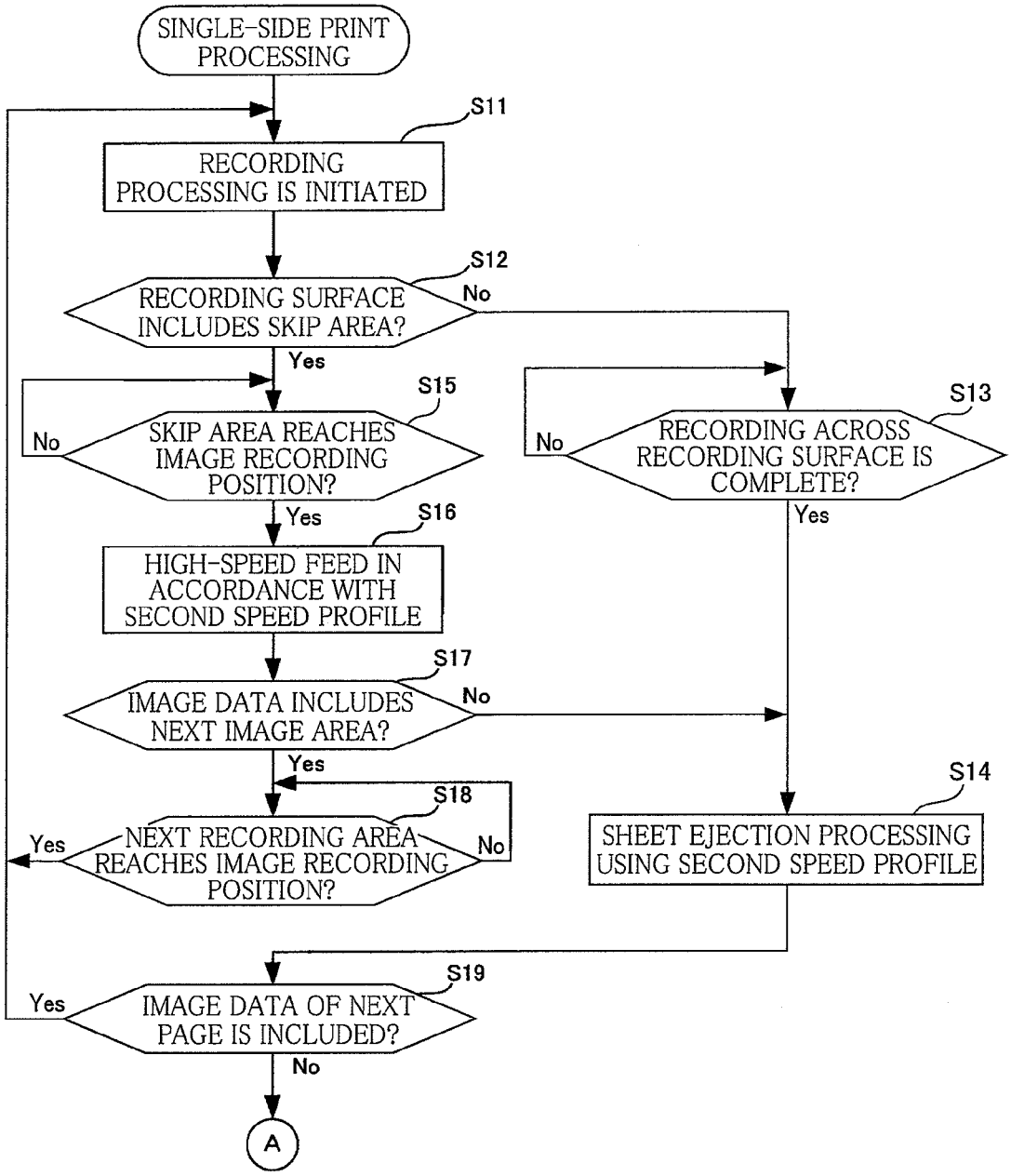
FIG. 10 is a flowchart illustrating a single-side print processing in the control operation.
Figure 11:
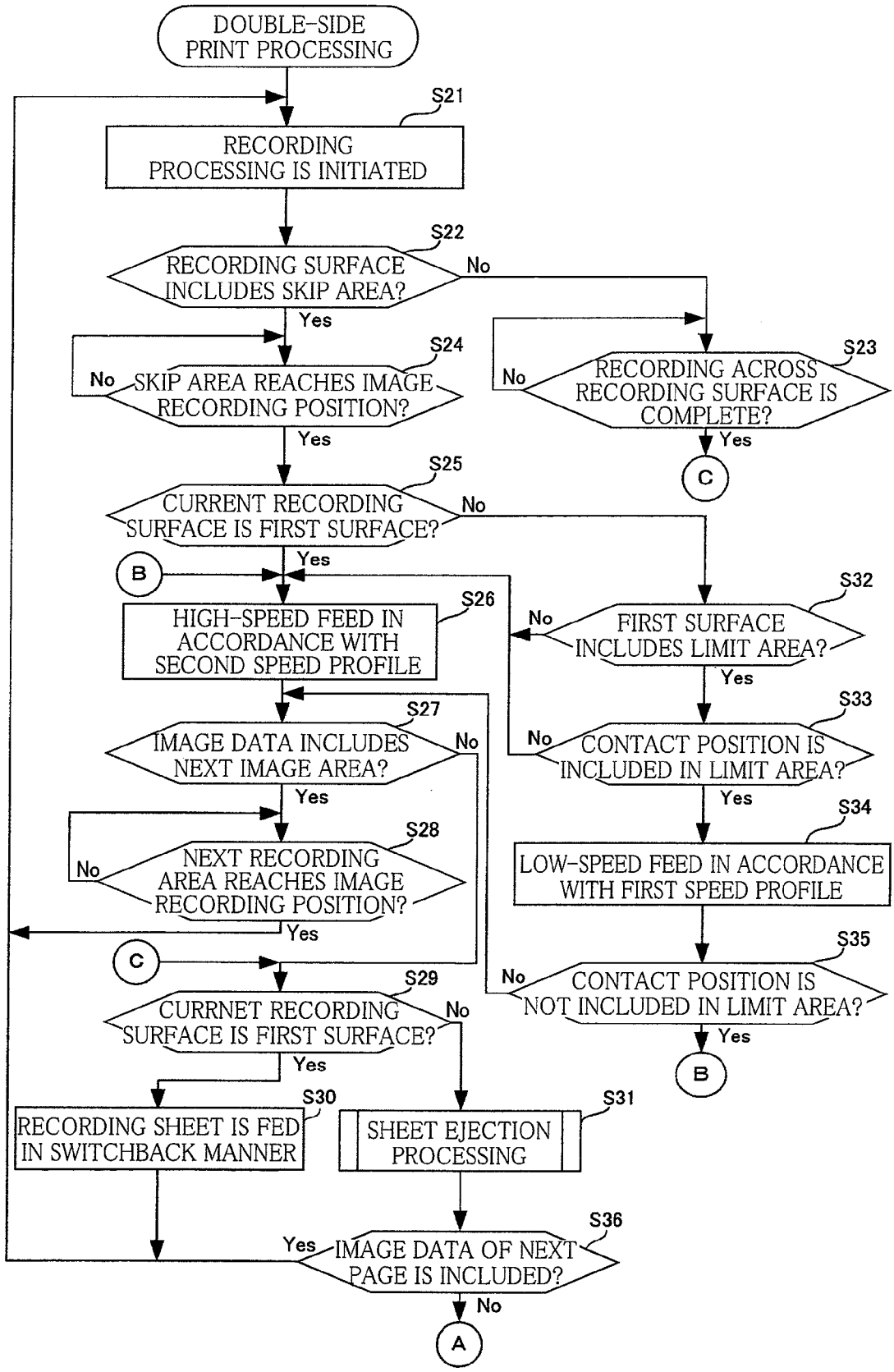
FIG. 11 is a flowchart illustrating a double-side print processing in the control operation.
Figure 12:
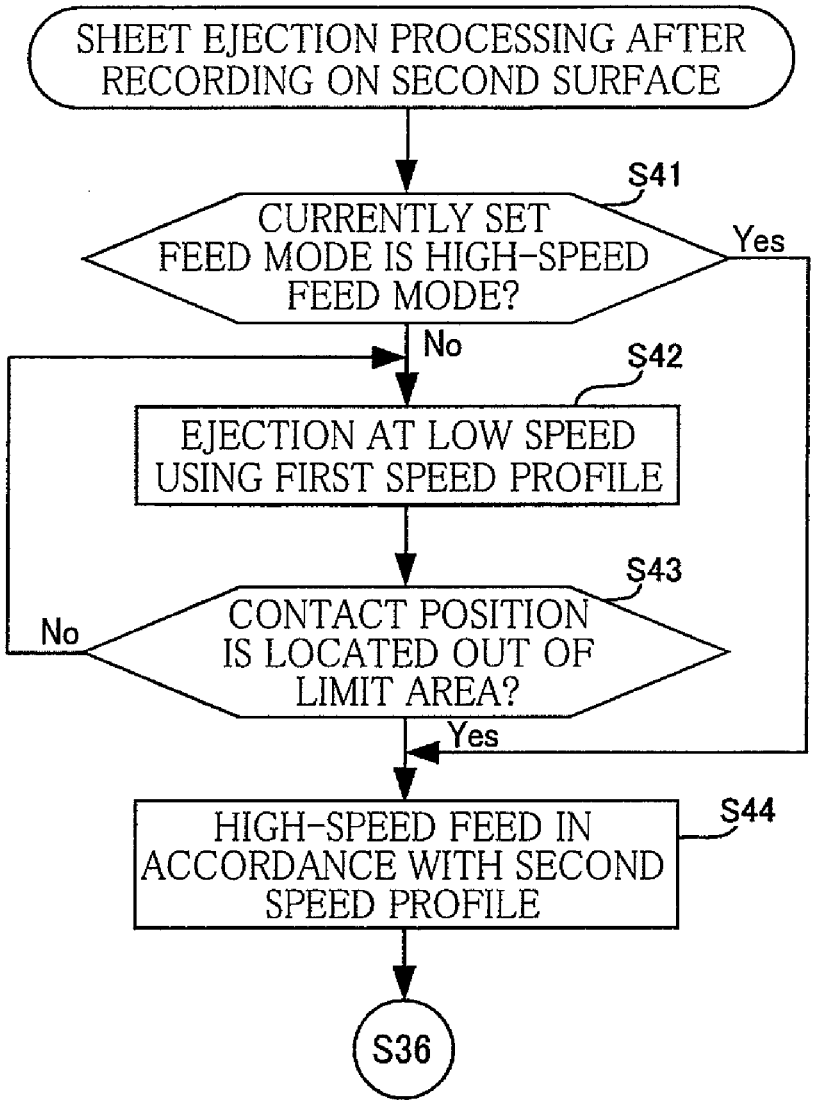
FIG. 12 is a flowchart illustrating a sheet ejection processing implemented after recording of an image on a second surface of a recording sheet.
Figure 13B:
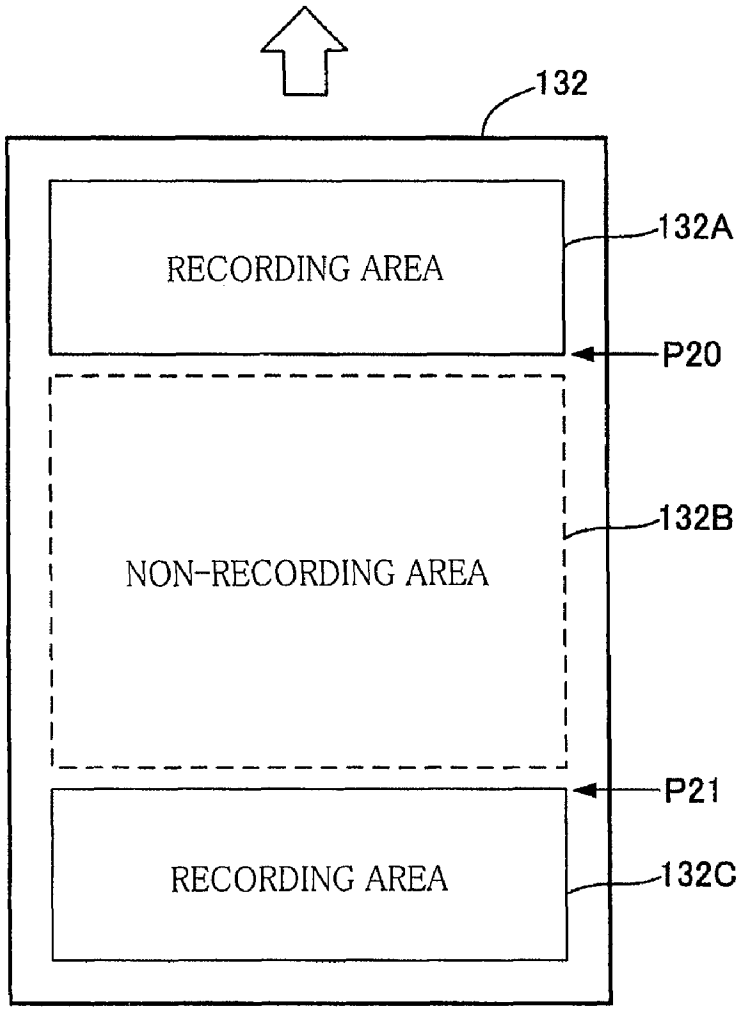
FIGS. 13A and 13B show a recording area and a non-recording area on a recording sheet.
Figure 13A:
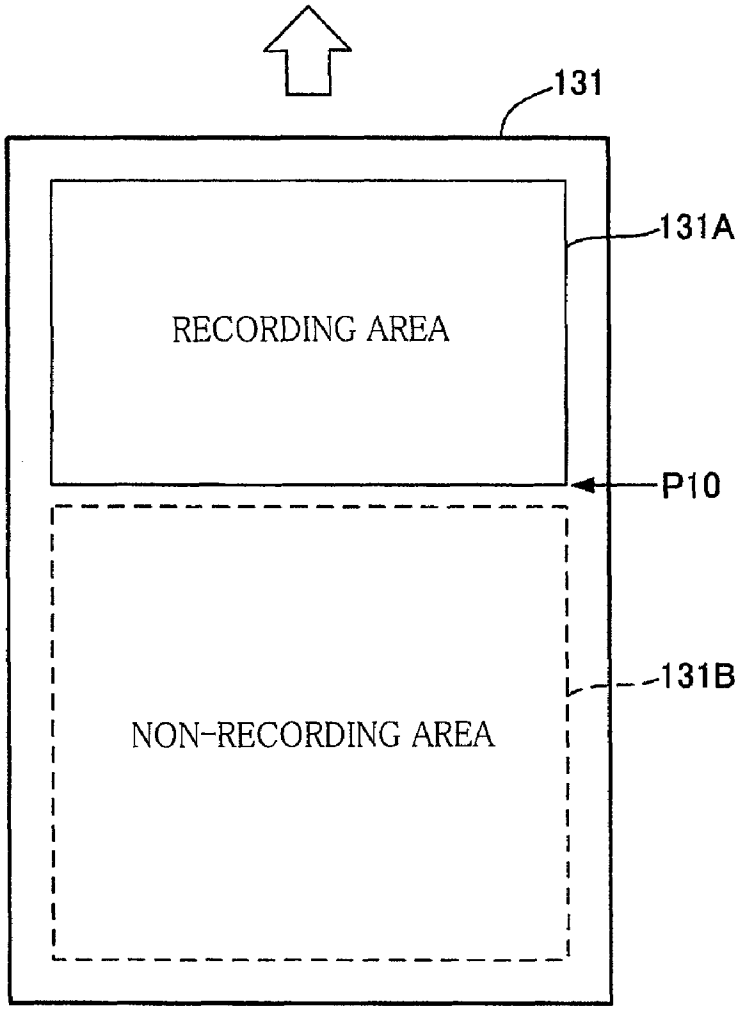
Figure 14:
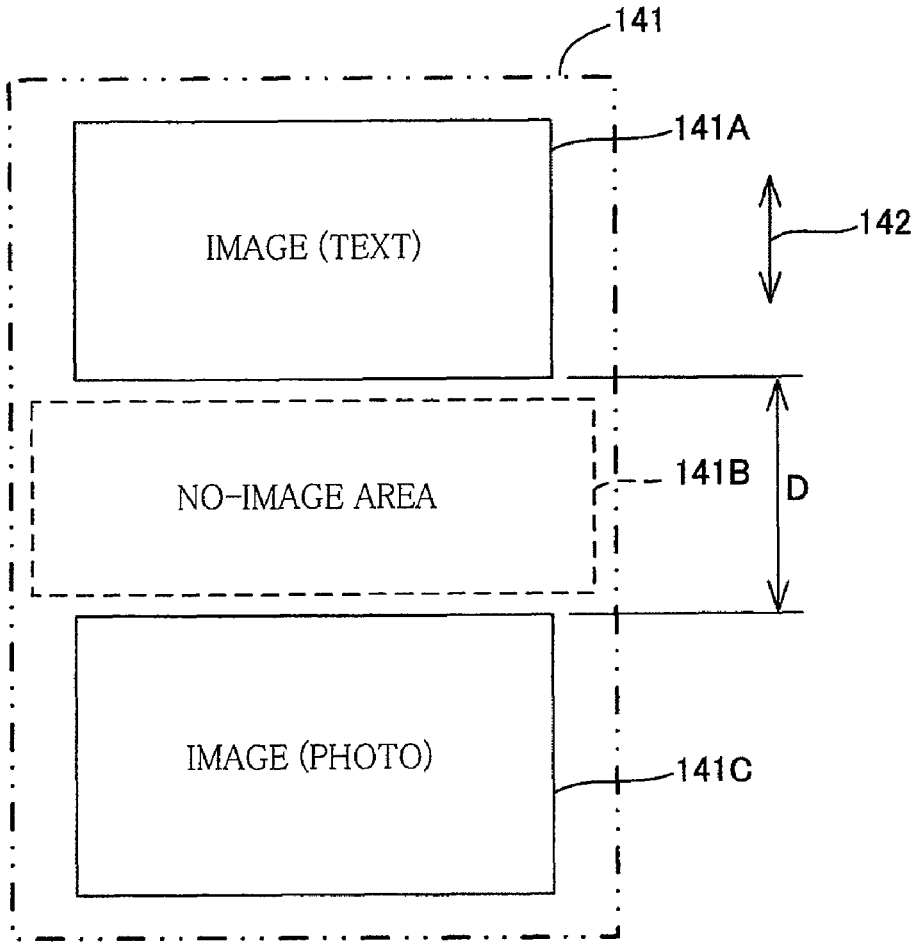
FIG. 14 schematically illustrates one example of image data recorded on a recording sheet.
Figure 16:
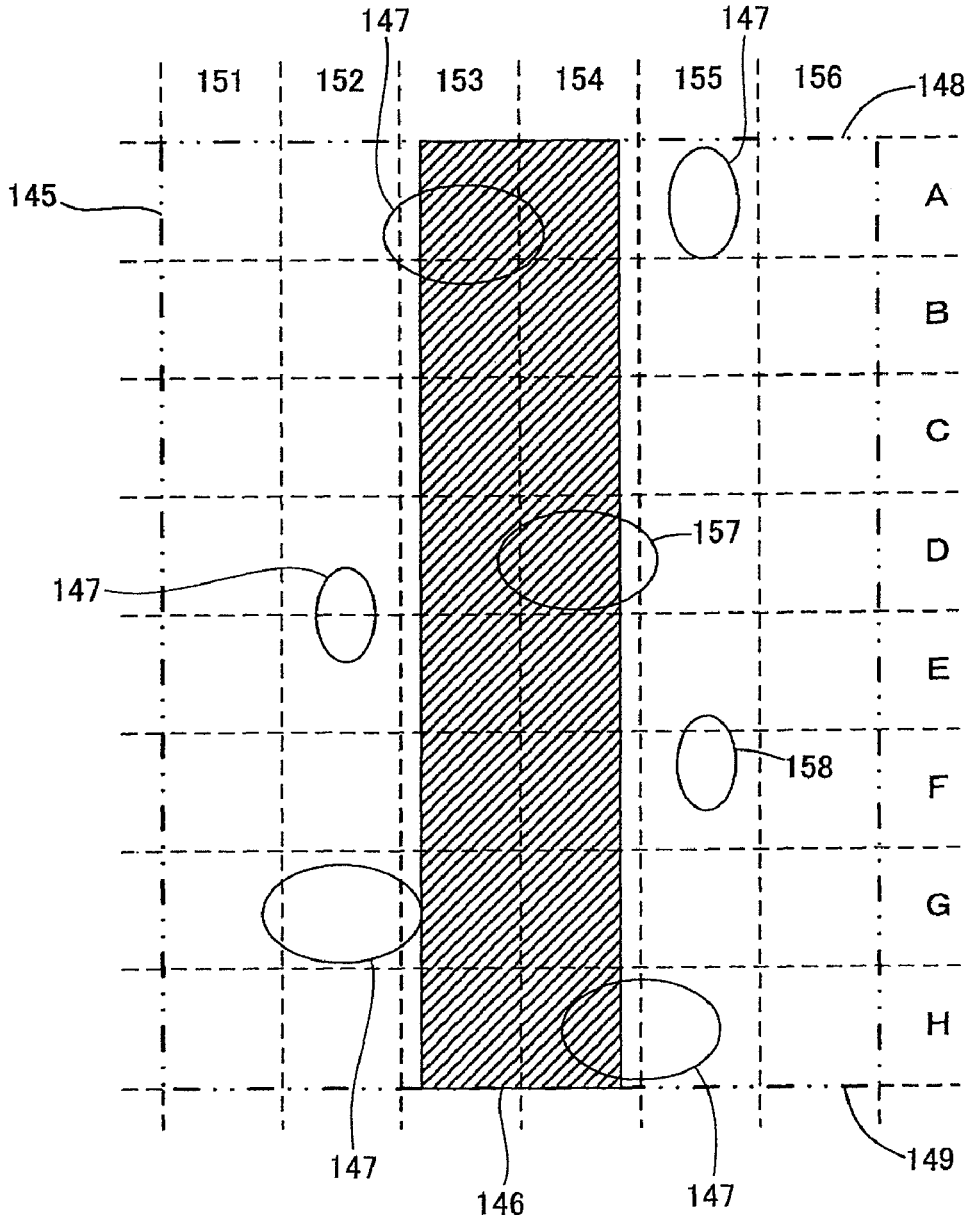
FIG. 16 schematically illustrates one example of image data recorded on a first surface of a recording sheet.

By referring to FIGS. 9-16, there will be described one example of a control operation implemented by the control unit 84 when an image is recorded by the printer portion 11. The flowcharts of FIGS. 9-11 illustrate the control operation implemented by the control unit 84. The flowchart of FIG. 12 illustrates a sheet ejection processing implemented by the control unit 84 after recording of an image on a second surface of a recording sheet. FIGS. 13A and 13B are schematic views of a recording area and a non-recording area on a recording sheet. FIG. 14 is a schematic view of one example of image data recorded on a recording sheet. FIGS. 15A and 15B show an example of speed profiles used in the skip feed. FIG. 16 is a schematic view of one example of image data recorded on a first surface of a recording sheet.

Referring to FIG. 9, the control operation is initiated with step S1 in which the CPU 88 determines whether print data is inputted from an external apparatus, e.g., personal computer, via the I/F 95. The print data includes a recording instruction signal, image data to be recorded on a recording sheet or sheets, and information on the size of the recording sheet(s). The recording instruction signal represents an instruction from the user to implement an image recording operation. In the embodiment, the term "image data" refers to not only data representative of a photograph or a picture, but may also refer to other kinds of data such as text data. That is, the image data may be any kind of data including an object to be recorded on a recording sheet by the recording portion 24.

When it is determined in step S1 that print data is inputted, an affirmative decision (YES) is made and the processing flow goes to the next step S2 in which the CPU 88 determines whether the image data included in the print data includes a no-image area. The term "no-image area" refers to an area based on the inputted image data where there is no image for which an image forming processing should be implemented. The image forming processing is a processing to actually eject ink droplets from the recording head 39. In this specific example, in step S2 it is determined on the basis of the image data whether the image data includes a no-image area having a length or a dimension in the feeding direction equal to or larger than a predetermined threshold. For instance, in a case where image data 141 shown in FIG. 14 is to be recorded on the recording sheet, it is determined whether the image data 141 includes any no-image area 141B whose length D or dimension in a longitudinal direction 142 of the recording sheet, which corresponds to the feeding direction, is equal to or larger than a threshold D1 that is suitably predetermined. When it is determined in step S2 that the image data does not include any no-image area, an affirmative decision (YES) is made and the control flow goes to step S3. On the other hand, when a negative decision (NO) is made in step S2, the control flow goes to step S4.

When an affirmative decision (YES) is made in step S2 and the control flow goes to step S3, the CPU 88 stores in the RAM 90 position information that is information related to the position of the no-image area in the image data. For instance, the position information may represent coordinates of a boundary between the no-image area and an adjacent image area (an area other than the no-image area). Based on the position information related to the position of the no-image area, the CPU 88 determines a non-recording area (hereinafter referred to as "the skip area") on a corresponding recording surface of the recording sheet. With respect to the non-recording area or skip area, the recording of the image data is to be skipped. After the skip area is determined in step S3, the control flow goes to step S4. It is noted that where image data is the same in size with a recording sheet, an area on a recording surface that corresponds to a no-image area specified by position information stored in the RAM 90 is regarded as a skip area.

The processing of step S3 is implemented for each page, that is, implemented for image data to be recorded across each single recording surface. That is, when the inputted print data includes image data of a plurality of pages to be recorded on respective recording surfaces, the processing of step S3 to determine a skip area is implemented with respect to image data of each of the pages. Therefore, when a double-side print processing is to be implemented later in step S7, a skip area on a first surface of the recording sheet is determined on the basis of the image data to be recorded on the first surface, and a skip area on the second surface of the recording sheet is determined on the basis of the image data to be recorded on the second surface. It is noted that the image data to be recorded on the first surface corresponds to first image data, the image data to be recorded on the second surface corresponds to second image data, and a skip area in the second surface corresponds to a second area.

In step S4, the CPU 88 determines whether it is instructed to implement a double-side print processing. This determination is made based on the kind of the inputted recording instruction signal described above. When the recording instruction signal indicates an instruction to implement a single-side print processing, a negative decision (NO) is made in step S4 and the control flow goes to step S5 to implement a single-side print processing. The single-side print processing will be described in detail later, with reference to a flowchart of FIG. 10.

On the other hand, when the recording instruction signal indicates an instruction to implement a double-side print processing, an affirmative decision (YES) is made in step S4 and the processing flow goes to step S6, in which the CPU 88 determines whether the image data to be recorded on the second surface of the recording sheet includes any area (hereinafter referred to as "the limit area") with respect to which a limitation is imposed on rotating speeds of the feeder roller 60 and the ejection roller 62.

There will be described in more detail the determination of a limit area in step S6. Assume that the image data to be recorded on the first surface of the recording sheet is image data 145 shown in FIG. 16. Ends of the image data 145 on the upper and lower sides as seen in FIG. 16 will be referred to as upper and lower ends 148, 149 of the image data 145, respectively. In the embodiment, where the printer portion 11 implements the double-side print processing, the recording sheet is fed in a switchback manner such that leading and trailing edges, in the feeding direction, of the recording sheet are inverted between recording on the first surface and that on the second surface. In other words, the leading edge of the recording sheet in the recording on the first surface becomes the trailing edge in the recording on the second surface. For this reason, when recording of the image data 145 is performed on the first surface of the recording sheet, the recording begins from the lower end 149 of the image data 145. That is, the leading edge of the recording sheet in the feeding direction when the image data 145 is recorded on the first surface of the recording sheet corresponds to the lower end 149 of the image data 145. A hatched area 146 vertically long and located at a widthwise center of the image data 145 as seen in FIG. 16 corresponds to an area at which the pickup roller 25 contacts the first surface when the recording sheet is fed in the switchback manner back toward the sheet supply tray 20 after the recording of the image data 145 on the first surface is complete. In FIG. 16, areas 147 in the image data 145 encircled by solid line represent image pieces to be recorded by the recording head 39, and the other part of the image data 145 than the areas 147 corresponds to a no-image area.

In step S5, when such image data 145 is recorded from its lower end 149 on the first surface of the recording sheet, the image data 145 is initially divided into a plurality of blocks (48 blocks in this specific example) arranged in a matrix, and an image density value of each block is obtained. For instance, the image density value of each block may be obtained based on an average value of gradation levels of respective pixels in the block. The obtained image density values of the blocks represent an image density distribution in the image data 145.

Based on the thus obtained image density values, it is determined whether any of the blocks has an image density value equal to or higher than a predetermined threshold. More specifically, the image density value of each block is compared with the threshold to determine or find any block having an image density value equal to or higher than the threshold. A block having such an image density value will be hereinafter referred to as a "dense block". It is noted that the dense block thus determined is one example of a first area. When there is determined or found at least one dense block, it is further determined whether any of the at least one dense block overlaps with the hatched area 146. When there is determined or found such a dense block overlapping with the hatched area 146, this dense block is determined to be a "limit area".

Assume that image pieces 157, 158 in the image data 145 are dense image pieces having a relatively high density, each of blocks 154D, 155F including the most part of the dense image pieces 157, 158, respectively, are determined to be the dense block having an image density value equal to or higher than the threshold. In this case, only the block 154D overlapping with the hatched area 146 is determined to be the limit area, and the block 155F which is determined to be the dense block but does not overlap with the hatched area 146 is not determined to be the limit area.

After the determination of the limit area in step S6, the control flow goes to step S7 in which a double-side print processing is implemented. The double-side print processing will be fully described later, with reference to a flowchart of FIG. 11.

Referring next to a flowchart of FIG. 10, there will be described the single-side print processing. The processing flow begins with step S11 in which the recording sheet is fed to the position over the platen 42, and then a recording processing on a recording surface of the recording sheet, which is a first surface in this cycle of the control operation, is initiated with the feeding of the recording sheet switched to intermittent from continuous.

The processing flow proceeds to step S12, in which it is determined whether the image data of a page corresponding to the current recording surface includes a skip area, that is, whether the RAM 90 stores position information of a no-image area of the image data. When a negative decision (NO) is obtained in step S12, the recording of the image data of the page is continued to the end without intermission and it is determined in the following step S13 that recording of the image data across the recording surface, i.e., the first surface of the recording sheet, is complete, that is, an affirmative decision (YES) is made in step S13. Then, the flow goes to step S14 in which the recording sheet, on the first surface of which the image data has been recorded, is ejected onto the catch tray 21. At this step S14, the CPU 88 sets a high-speed feed flag, which means that the printer portion 11 is placed in a high-speed feed mode, reads out the second speed profile 202 of FIG. 15B from the ROM 89, and drives the LF motor 71 in accordance with the second speed profile 202. That is, in order that the rotating speed of the LF motor 71 becomes the second speed value V2 larger than the first speed value V1 at the time t1 at which the acceleration of the LF motor 71 is terminated, the LF motor 71 is accelerated at the second acceleration value a2 larger than the first acceleration value a1. In this way, the feeder roller 60 and the ejection roller 62 are rotated at high speed, thereby feeding and ejecting the recording sheet continuously and at high speed. Step S14 is followed by step S19 in which it is determined whether the image data included in the inputted print data includes image data of a next page. When the image data included in the print data includes image data of a next page and an affirmative decision (YES) is made in step S19, the flow returns to step S11 to repeat step S11 and the following steps. On the other hand, when the image data included in the print data does not include image data of a next page, a negative decision (NO) is made in step S19 and this cycle of the single-side print processing flow is terminated.

On the other hand, when an affirmative decision (YES) is made in step S12, that is, when a skip area is included in the image data of the page corresponding to the current recording surface, namely, when the RAM 90 stores position information of a no-image area, the image forming processing is continued to record an image until the skip area on the first surface of the recording sheet reaches the image recording position, that is, until an affirmative decision (YES) is made in step S15. That is, in step S15 the CPU 88 determines whether a leading end of the skip area reaches the image recording position. This determination is made on the basis of a position of the recording sheet in the feed path 23 and the position information of the no-image area stored in the ROM 89. The position of the recording sheet can be obtained on the basis of output signals from the registration sensor 102 and the second rotary encoder 87.

When it is determined in step S15 that the leading end of the skip area reaches the image recording position and an affirmative decision (YES) is made, the flow goes to step S16 in which the CPU 88 sets the high-speed feed flag, reads the second speed profile 202 of FIG. 15B from the ROM 89, and drives the LF motor 71 in accordance with the second speed profile 202. Thus, the feeder roller 60 and the ejection roller 62 are rotated at high speed, thereby feeding the recording sheet at high speed so as to skip the recording of the image data at the skip area on the first surface of the recording sheet.

In the following step S17, it is determined whether there is a next image area in the image data of the page currently recorded on the first surface of the recording sheet. The image area corresponds to a next recording area on the first surface. When there is a next image area and an affirmative decision (YES) is made in step S17, the high-speed feed of step S16 is continued until a leading end of the next recording area on the first surface reaches the image recording position. When in the following step S18 it is determined that the leading end of the next recording area reaches the image recording position and an affirmative decision (YES) is made, the processing flow returns to step S11 to repeat step S11 and the following steps. On the other hand, when it is determined in step S17 that there is not a next image area in the image data and a negative decision (NO) is made, the flow goes to step S14 to eject the recording sheet onto the catch tray, keeping the mode of the feeding of the recording sheet at the high-speed feed mode.

Referring next to the flowchart of FIG. 11, there will be described the double-side print processing. This processing flow begins with step S21 in which a recording sheet is fed to the position over the platen 42, and then a recording processing is initiated with the feeding of the recording sheet changed to intermittent from continuous. In the following description, detailed description of the same processings as the corresponding processings in the single-side print processing is not provided.

In the next step S22, it is determined whether the image data of the page currently recorded includes a skip area. When a negative decision (NO) is obtained in step S22, the recording of the image data is continued to the end without intermission and it is determined in the following step S23 that recording of the image data across the recording surface is complete. That is, an affirmative decision (YES) is made in step S23. In this case, the processing flow goes to step S29 to determine whether the recording surface on which the image data has been recorded is the first surface of the recording sheet.

On the other hand, when it is determined in step S22 that a skip area is included in the image data being recorded, an affirmative decision (YES) is made and the image forming processing is continued until the skip area corresponding to the no-image area reaches the image recording position. That is, in step S24 the CPU 88 determines whether a leading end, in the feeding direction, of the skip area reaches the image recording position.

When an affirmative decision (YES) is made in step S24, the processing flow goes to step S25 in which it is determined whether the recording surface on which the image data is being recorded is the first surface of the recording sheet. When an affirmative decision (YES) is made in step S25, the flow goes to step S26 in which the CPU 88 sets the high-speed feed flag, reads out the second speed profile 202 of FIG. 15B stored in the ROM 89, and drives the LF motor 71 in accordance with the second speed profile 202. Thus, the feeder and ejection rollers 60, 62 are rotated at high speed to feed the recording sheet at high speed, so as to skip the recording of the image data at the skip area.

When there is a next recording area on the first surface of the recording sheet, the high-speed feed in step S26 is continued until a leading end in the feeding direction of the next recording area reaches the image recording position. That is, in step S27 it is determined whether there is a next recording area on the first surface, and when an affirmative decision (YES) is made in step S27, the flow goes to step S28 in which it is determined whether the leading end of the next recording area reaches the image recording position. When an affirmative decision (YES) is made in step S28, the flow returns to step S21 to repeat step S21 and the following steps. On the other hand, when it is determined in step S27 that there is not a next recording area on the first surface, i.e., when a negative decision (NO) is made in step S27, the flow goes to step S29 to determine whether the recording surface across which recording of the image data is complete is the first surface.

When it is determined in step S29 that the recording surface across recording of the image data is complete is the first surface, an affirmative decision (YES) is made and the flow goes to step S30, in which the recording sheet with an image just recorded on its first surface is once fed into the ejection path 23B and then into the reverse guide path 16 from the trailing edge thereof, in a switchback manner. On the other hand, when it is determined in step S29 that the recording surface across recording of the image data is complete is not the first surface, a negative decision (NO) is made and the flow goes to step S31 in which a sheet ejection processing, which is a processing designed to be implemented after recording of an image on a second surface of a recording sheet, is implemented and the recording sheet is ejected onto the catch tray 21. The sheet ejection processing of step S31 will be described later.

On the other hand, when it is determined in step S25 that the recording surface on which the image data is being recorded is not the first surface but is the second surface, a negative decision (NO) is made and the flow goes to step S32 in which it is determined whether the first surface includes a limit area (described above with respect to step S6). When it is determined in step S32 that the first surface does not include a limit area, a negative decision (NO) is made and the flow goes to step S26 to implement step S26 and the following steps. On the other hand, when it is determined in step S32 that the first surface includes a limit area, an affirmative decision (YES) is made and the flow goes to step S33 to determine whether a position on the first surface at which the pickup roller 25 contacts the first surface is within the limit area. That is, in a case where the recording surface on which an image is being recorded is the second surface and the first surface includes a limit area, when a leading end of a skip area reaches the image recording position and the skip feed, i.e., a skip of a skip area on the recording sheet, is initiated, it is determined whether the position on the first surface of the recording sheet at which the pickup roller 25 contacts the first surface is included in the limit area. The position on the first surface at which the pickup roller 25 contacts the first surface (which will be hereinafter referred to as "the contact position") can be determined based on the position of the pickup roller 25 and a position of the recording sheet in the feed path 23. The determination of whether the contact position is included in the limit area can be made based on the position or range of the limit area.

When it is determined in step S33 that the contact position is not included in the limit area, a negative decision (NO) is made and the flow goes to step S26 to drive the LF motor 71 in accordance with the second speed profile 202 of FIG. 15B so as to feed the recording sheet in the high-speed feed mode. Then, the steps following step S26 as described above are implemented. It is noted that the mode of feeding of the recording sheet in step S26 as implemented following step S33 corresponds to a second control mode.

On the other hand, when it is determined in step S33 that the contact position is included in the limit area, an affirmative decision (YES) is made and the flow goes to step S34 in which the CPU 88 sets a low-speed feed flag, i.e., the printer portion 11 is placed in a low-speed feed mode, reads out the first speed profile 201 of FIG. 15A stored in the ROM 89, and drives the LF motor 71 in accordance with the first speed profile 201. That is, the LF motor 71 is accelerated at the first acceleration value a1 smaller than the second acceleration value a2 in order that at the time t1 at which the acceleration of the LF motor 71 is terminated, the rotating speed of the LF motor 71 becomes the first speed value V1 smaller than the second speed value V2. Thus, the feeder roller 60 and the ejection roller 62 are rotated at low speed so as to feed the recording sheet at low speed and continuously. In this case where the recording sheet is fed in the low-speed feed mode, the pickup roller 25 does not slip. Thus, even when the pickup roller 25 contacts the first surface at the limit area, the ink forming the image within the limit area on the first surface does not transfer and adhere to an outer circumferential surface of the pickup roller 25, as well as the image formed or recorded within the limit area is not destroyed or rubbed off, preventing degradation of the quality of the image recorded on the first surface. It is noted that the mode of feeding of the recording sheet in step S34 corresponds to a first control mode.

In the following step S35, it is determined whether the contact position shifts out of the limit area and is located outside the limit area. This determination can be made based on the positions of the recording sheet, limit area, and pickup roller 25. When it is determined in step S35 that the contact position is located outside the limit area, an affirmative decision (YES) is made and the flow goes to step S26 to switch the feed mode of the recording sheet from low-speed to high-speed. When the contact position is outside the limit area, the ink forming the image on the first surface does not transfer or adhere to the outer circumferential surface of the pickup roller 25 even when the pickup roller 25 slips on the first surface. Therefore, in order to enhance the efficiency in feeding of the recording sheet, the feed mode is switched from low-speed to high-speed. On the other hand, when it is determined in step S35 that the contact position is not located outside the limit area, a negative decision (NO) is made and the flow goes to step S27 with the recording sheet kept fed at low speed, that is, the printer portion 11 is continuously placed in the low-speed feed mode.

Referring next to a flowchart of FIG. 12, there will be described the sheet ejection processing of step S31. As shown in FIG. 12, the sheet ejection processing, which is implemented after the recording on the second surface of a recording sheet is complete, follows steps S41-S44. That is, the sheet ejection processing is initiated with step S41 in which it is determined whether the feed mode in which the printer portion 11 is currently placed is the high-speed feed mode or not. For instance, in the processing flow in FIG. 11, in a case where the flow has proceeded in the order of steps S26, S27, S29 and S31, the feed mode in which the printer portion 11 is currently placed is the high-speed feed mode, that is, the high-speed feed flag is currently set. In another case where the processing flow of FIG. 11 has proceeded in the order of steps S34, S35, S27, S29 and S31, the feed mode in which the printer portion 11 is currently placed is low-speed, that is, the low-speed feed flag is currently set. The determination in step S41 of whether the printer portion 11 is currently placed in the high-speed feed mode is made by the CPU 88 based on the currently set one of the high-speed and low-speed feed flags.

When it is determined in step S41 that the feed mode in which the printer portion 11 is currently placed is the high-speed feed mode, an affirmative decision (YES) is made and the processing flow goes to step S44 to continue the high-speed feed of the recording sheet until the recording sheet is ejected onto the catch tray 21. The flow then goes to step S36 in the flowchart of the double-side print processing in FIG. 11. It is noted that the mode of feeding of the recording sheet in step S44 corresponds to a fourth control mode.

On the other hand, when it is determined in step S41 that that the feed mode in which the printer portion 11 is currently placed is not the high-speed feed mode, a negative decision (NO) is made and the processing flow goes to step S42 to continue the low-speed feed of the recording sheet, until in the following step S43 it is determined that the contact position is located outside the limit area. That is, in step S43, the same processing as in step S35 is implemented. When it is determined in step S43 that the contact position is located outside the limit area, an affirmative decision (YES) is made and the flow goes to step S44 to switch the feed mode of the recording sheet from low-speed to high-speed. On the other hand, when it is determined in step S43 that the contact position is not located outside the limit area, a negative decision (NO) is made and the printer portion 11 is continuously placed in the low-speed feed mode until it is determined in step S43 that the contact position is located outside the limit area. It is noted that the mode of feeding of the recording sheet in step S42 corresponds to a third control mode.

According to the embodiment where the double-side print processing is implemented as described above, when the skip feed is implemented during recording of an image on the second surface of a recording sheet, the LF motor 71 is rotated at low speed in order to inhibit the pickup roller 25 from slipping in the case where the contact position on the first surface of the recording sheet, at which the pickup roller 25 contacts the first surface at the moment of initiation of the skip feed, is included in the limit area (described above with respect to step S6). This prevents slippage of the pickup roller 25 on the first surface that might cause contamination of the outer circumferential surface of the pickup roller 25 with the ink, and degradation in the quality of the image recorded on the first surface. On the other hand, when the contact position on the first surface is not included in the limit area, the LF motor 71 is rotated at high speed so as to feed the recording sheet at high speed, thereby enhancing the throughput in the double-side print processing.

In step S6 of the flowchart of the control operation in FIG. 9, the image density values of all the blocks of the image data is obtained. This acquisition of the image density values may be implemented only with respect to a block in which an image piece is formed using a black ink that is a pigment ink. That is, when an image is recorded by an inkjet recording method, it is typical that a black pigment ink and dye inks of colors other than black are used. A dye ink easily penetrates into a recording sheet as compared to a pigment ink. Thus, an image formed with a dye ink does not tend to be destroyed or rubbed off of the recording sheet, but an image formed with a pigment ink is easily destroyed or rubbed off. Hence, when the pickup roller 25 slips on the first surface of a recording sheet on which an image has been recorded or formed using a black pigment ink and dye inks of colors other than black, it may occur that only a portion of the image formed using the black pigment ink is destroyed or rubbed off. Therefore, even the arrangement where the acquisition of the image density values is implemented only with respect to the block in which an image piece is formed using the black pigment ink can obtain the effect of the invention to prevent contamination of the outer circumferential surface of the pickup roller 25 and degradation in the quality of the image recorded on the first surface due to slippage of the pickup roller 25.

Although there has been described one embodiment of the invention, it is to be understood that the invention is not limited to the details of the embodiment, but may be otherwise embodied with various modifications and improvements that may occur to those skilled in the art, without departing from the scope and spirit of the invention defined in the appended claims.

What is claimed is:

1. An image recording apparatus comprising:

a recording head which ejects ink droplets onto a recording medium so as to record an image;

a feeding mechanism which feeds a recording medium on a first surface of which an image has been recorded, such that a second surface of the recording medium opposite to the first surface is opposed to the recording head;

a first-area determining portion which determines a first area based on an image density distribution of the first image data to be recorded on the first surface, the first area having an image density value not lower than a predetermined threshold;

a second-area determining portion which determines a second area at which recording of an image on the second surface is not implemented, based on a no-image area of second image data to be recorded on the second surface;

a contact-position determining portion which determines a contact position on the first surface at which position a roller rotated by contact thereof with the first surface contacts the first surface, where the second surface is opposed to the recording head;

a feed controller which controls feeding of the recording medium by the feeding mechanism, and is capable of controlling the feeding of the recording medium such that where the second surface is opposed to the recording head, the recording of the image on the second surface is implemented with the second area skipped;

a judging portion which determines whether the contact position determined by the contact-position determining portion is included in the first area at the moment of initiation of a skip operation of the second area; and the feed controller controlling an acceleration or a speed at which the recording medium is fed in the skip operation, on the basis of a result of the determination made by the judging portion.

2. The image recording apparatus according to claim 1, wherein the feed controller controls the feeding mechanism (i) in a first control mode when the judging portion determines that the contact position is included in the first area at the moment of initiation of the skip operation, and (ii) in a second control mode when the judging portion determines that the contact position is not included in the first area at the moment of initiation of the skip operation, the recording medium being fed at a first feed acceleration value or a first feed speed value in the first control mode, and the recording medium being fed at a second feed acceleration value larger than the first feed acceleration value or a second feed speed value larger than the first feed speed value in the second control mode.

3. The image recording apparatus according to claim 2, wherein the feed controller switches the mode of control of the feeding mechanism from the first control mode to the second control mode when the contact position is not included in the first area while the feed controller controls the feeding mechanism in the first control mode.

4. The image recording apparatus according to claim 1, further comprising an ejection controller which controls ejection of the recording medium by the feeding mechanism, wherein the feeding mechanism is capable of ejecting the recording medium onto an ejection portion after the recording on both the first surface and the second surface is complete, and the ejection controller controls the feeding mechanism (iii) in a third control mode when the recording medium is to be ejected while fed in the first control mode and (iv) in a fourth control mode when the recording medium is to be ejected while fed in the second control mode, the recording medium being ejected at a first ejection acceleration value or a first ejection speed value in the third control mode, and the recording medium being ejected at a second ejection acceleration value larger than the first ejection acceleration value or a second ejection speed value larger that the first ejection speed value in the fourth control mode.

5. The image recording apparatus according to claim 4, wherein the ejection controller switches the mode of control of the feeding mechanism from the third control mode to the fourth control mode when the contact position is not included in the first area while the ejection controller controls the feeding mechanism in the third control mode.

6. The image recording apparatus according to claim 1, wherein the first-area determining portion determines the first area, based on a density distribution of a color of the first image data recorded on the first surface, the color being recorded with a pigment ink.

7. The image recording apparatus according to claim 6, wherein the color is black.

8. The image recording apparatus according to claim 1, wherein the second-area determining portion determines, as the second area, an area that corresponds to the no-image area on the second surface and has a dimension larger than a predetermined threshold in a direction corresponding to a direction in which the recording medium is fed.

9. The image recording apparatus according to claim 1, wherein the first-area determining portion includes a limit-area determining portion which determines, as a limit area, an area where the first area determined by the first-area determining portion and an area on the first surface at which the roller contacts the first surface overlap with each other, and wherein the feed controller controls the feeding mechanism to feed the recording medium (i) at a first feed acceleration value or a first feed speed value when the judging portion determines that the contact position is included in the limit area at the moment of initiation of the skip operation, and (ii) at a second feed acceleration value larger than the first feed acceleration value, or a second feed speed value larger than the first feed speed value when the judging portion determines that the contact position is not included in the limit area at the moment of initiation of the skip operation.

10. The image recording apparatus according to claim 9, wherein when the first surface of the recording medium does not include any limit area, the feed controller controls the feeding mechanism to feed the recording medium at the second feed acceleration value or the second feed speed value.

11. The image recording apparatus according to claim 1, further comprising:

a tray on which a stack of recording media is placed; and an arm disposed above the tray and on a mainbody frame of the image recording apparatus such that the arm is swingable, wherein the roller is supported at a distal end of the arm, and is rotated by contact thereof with an upper surface of the stack of recording media on the tray so as to supply the recording media toward the feeding mechanism.

* * * * *